US006708014B2

(12) United States Patent
Miyaguchi et al.

(10) Patent No.: US 6,708,014 B2
(45) Date of Patent: Mar. 16, 2004

(54) ELECTROSTATIC TRANSPORTATION DEVICE, DEVELOPMENT DEVICE AND IMAGE FORMATION APPARATUS

(75) Inventors: Yohichiro Miyaguchi, Tokyo (JP); Nobuaki Kondoh, Tokyo (JP); Takeshi Takemoto, Tokyo (JP); Katsuo Sakai, Tokyo (JP); Masanori Horike, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/098,125

(22) Filed: Mar. 15, 2002

(65) Prior Publication Data

US 2002/0131795 A1 Sep. 19, 2002

(30) Foreign Application Priority Data

Mar. 15, 2001 (JP) ..... 2001-073565
Feb. 13, 2002 (JP) ..... 2002-034814

(51) Int. Cl.[7] ..... G03G 15/08
(52) U.S. Cl. ..... 399/266; 399/289; 399/291
(58) Field of Search ..... 399/55, 252, 265, 399/266, 289, 290, 291; 361/233

(56) References Cited

U.S. PATENT DOCUMENTS 4,558,941 A * 12/1985 Nosaki et al. ..... 399/266
4,598,991 A * 7/1986 Hosoya et al. ..... 399/266
5,027,157 A * 6/1991 Hotomi et al. ..... 399/266 X
5,079,591 A 1/1992 Tomita et al.
5,281,982 A * 1/1994 Mosehauer et al. ..... 399/291 X
5,729,807 A * 3/1998 Parker ..... 399/266 X
5,761,591 A * 6/1998 Yamaguchi ..... 399/289
5,848,327 A * 12/1998 Badesha et al. ..... 399/266 X
5,955,228 A 9/1999 Sakai et al.
6,134,412 A * 10/2000 Thompson ..... 399/266
6,137,979 A * 10/2000 Gartstein et al. ..... 399/266
6,175,707 B1 * 1/2001 Eklund et al. ..... 399/265
6,219,515 B1 * 4/2001 Lestrange ..... 399/289

FOREIGN PATENT DOCUMENTS

| | | |
|---|---|---|
| JP | 59-181375 | 10/1984 |
| JP | 63-013068 | * 1/1988 |
| JP | 05-019615 | 1/1993 |
| JP | 07-267363 | 10/1995 |
| JP | 08-149859 | 6/1996 |
| JP | 09-197781 | 7/1997 |
| JP | 09-329947 | 12/1997 |
| JP | 11-115235 | 4/1999 |
| JP | 11-170591 | 6/1999 |
| JP | 11-179951 | 7/1999 |

* cited by examiner

*Primary Examiner*—Sandra Brase
(74) *Attorney, Agent, or Firm*—Oblon, Spivak, McClelland, Maier & Neustadt, P.C.

(57) ABSTRACT

An electrostatic transportation device is provided with a transporting base plate having a plurality of electrodes which generate an electric field which performs transporting and hopping of fine particles by an electrostatic force, wherein a width of each of the electrodes in a travelling direction of the fine particles is set to be in a range of 1 time to 20 times an average particle diameter of the fine particles, a pitch between the electrodes in the travelling direction of the fine particles is set to be in a range of 1 time to 20 times the average particle diameter of the fine particles, and driving waveforms of n phases or more (n is an integer of 3 or more) are applied to respective electrodes.

66 Claims, 17 Drawing Sheets

ELECTROSTATIC TRANSPORTATION DEVICE, DEVELOPMENT DEVICE AND IMAGE FORMATION APPARATUS

FIELD OF THE INVENTION

The present invention relates to an electrostatic transportation device, a development device and an image formation apparatus.

BACKGROUND OF THE INVENTION

As an image formation apparatus such as a reproducing machine, a printer, a facsimile or the like, there is one where a latent image is formed on a latent image carrier using an electrostatic photographic process, developer (hereinafter, referred to as toner, too) as a fine particle is attached to the latent image to develop the latent image and visualize the latent image as a toner image, and an image is formed by transferring the toner image onto a recording medium (including an intermediate transferring member).

In such an image formation apparatus, as a development device for developing a latent image, there has been conventionally known one where toner which is stirred in a development device is carried to a surface of a developing roller which is a developing agent carrier, the toner is transported to a position opposed to a surface of a latent image carrier by rotating the developing roller, the latent image of the latent image carrier is developed, toner which has not been transferred to the latent image carrier is recovered in the development device after the development by rotation of the developing roller, toner is newly stirred/charged and carried and transported.

Also, as the image formation apparatus, there has been known one where developing is carried out by a so-called jumping developing system where toner is transferred from a developing roller to a latent image carrier with non-contact, as described in Japanese Patent Application Laid-Open (JP-A) No. 09-197781 and JP-A 09-329947.

Further, as the image formation apparatus, there has been known one where toner is transported on a developing roller surface using electrostatic force, toner is separated from the developing roller surface by attracting force occurring between the toner and a latent image carrier to be attached to a latent image carrier surface, as described in JP-A 05-19615, or one where toner is transported at a position opposed to a latent image carrier using a transporting base plate for transporting toner with electrostatic force, and the toner is separated from a transporting surface with attracting force occurring between the latent image carrier and the toner to be attached to a surface of the latent image carrier, as described in JP-A 59-18375 or the like.

Also, as another image formation apparatus, there has been known a flying type (toner jetting type) image formation apparatus where a control electrode is disposed between a developing roller carrying toner and a recording medium and a back electrode is disposed behind the recording medium, toner is made flyable in a direction of the recording medium by generating electric field between the back electrode and the developing roller, and an image is formed on the recording medium by selectively controlling the flying of toner with the control electrode, as described in JP-A 11-170591, JP-A 11-115235 and JP-A 11-179951.

Also, as fine particles transporting apparatus for transporting fine particles such as toner particles, there has been one where fine particles are transported using spatial travelling-wave field, as described in JP-A 07-267363. This apparatus is structured such that a spatial travelling-wave field is formed around an electrode by applying a driving voltage to the electrode and repelling force and driving force act and charged fine particles by the travelling-wave field so that the fine particles are transported in a travelling direction of the field. As a classifying apparatus for classifying fine particles such as toner particles or the like using this spatial travelling-wave field, there has been proposed one where classification (fractionation) is performed by applying electrostatic force, weight, centrifugal force or the like to the fine particles, as described in JP-A8-149859.

However, in the image formation apparatus provided with the development device applying toner to a latent image carrier using the developing roller, or the flying type image formation apparatus where toner is carried on a developing roller and the toner is flied from the developing roller to a recording medium by controlling an electric field, toner invades a space between the developing roller and a side plate of the development device, in which the toner is rubbed and toner solidification occurs, which results in adverse influence on an image, or a seal member around the development device has been degraded according time elapse, toner is scattered by stirring/charging the developer or toner in the development device, which results in a background dirt of an image.

Furthermore, when toner has been charged by frictional charging or charging due to corona discharging, saturated charged toner section and unsaturated charge toner section exist in a mixed manner so that the toner has a large charge distribution. When such toner is forcibly transferred to a developing roller using a magnetic brush or a transferring roller, toner section of the toner which has been once carried on the developing roller is detached from the developing roller in a state where a developing speed of the developing roller is a speed (linear speed of 100 cm/VHF or so) so that toner may be scattered or a background for a formed image becomes dirty easily.

Further, in the development device which performs the so-called jumping development, since delivery and reception of toner which has been charged with a high voltage must be performed, there is a problem that a high voltage power source is required, which results in large-sizing of an apparatus and increase in cost.

On the other hand, the present inventors have studied the conventional electrostatic transportation device which transports toner using an electrostatic force obtained by a spatial travelling-wave field and they have found that, in the conventional electrostatic transportation device where each of a plurality of electrodes is set to be 150 to 250 $\mu$m and an interval between the electrodes is set to be 250 to 500 $\mu$m, toner stays in a mountain manner between the adjacent electrodes so that stable toner transportation can not be achieved effectively.

Also, when toner is transported by an electrostatic force, since toner particles are different in size and shape, there is such a problem that it is difficult to achieve a stable transportation, it is required to achieve matching between the toner and the charging member in the conventional electrostatic transporting apparatus, and so on.

SUMMARY OF THE INVENTION

It is an object of the invention to provide an electrostatic transporting apparatus which allows stable and efficient transportation and hopping of fine particles and provide a development device and an image formation apparatus where, using ETH (Electrostatic Transport & Hopping) phenomenon, configuration can be simplified and cost reduction can be achieved, a low voltage driving is allowed, and a high image quality can be obtained.

The ETH phenomenon means a phenomenon where fine particles are applied with energy of phase-shifting field, the energy is transformed to mechanical energy, and the fine particles themselves fluctuate dynamically. The ETH phenomenon is a phenomenon including movement (transportation) of fine particles in a horizontal direction due to electrostatic force and movement (hopping) of fine particles in a vertical direction due to electrostatic force, and it is a phenomenon where fine particles jump on an electrostatic transporting base plate with a component of a travelling direction due to a phase-shift field. A phenomenon utilizing the ETH phenomenon is called ETH phenomenon.

When behaviors of fine particles on a transporting base plate are expressed in a distinguishing manner, "transportation", "transporting speed", "transporting direction" and "transporting distance" are used for movement of a horizontal direction to a transporting body, and "hopping", "hopping speed", "hopping direction" and "hopping height (distance)" are used for fly (movement) of in a vertical direction to the transporting body. Incidentally, "carry" included in the terms "electrostatic transportation device" and "carrying body" is synonymous with "movement".

According to one aspect of the present invention, there is provided an electrostatic transportation device comprising a transporting base plate having a plurality of electrodes which generate a electric field which performs carrying and hopping of fine particles by electrostatic force, wherein the width of each electrode in a travelling direction of fine particles is set to be in a range of 1 time to 20 times an average particle diameter of the fine particles, the pitch between adjacent electrodes in the travelling direction of fine particles is set to be in a range of 1 time to 20 times the average particle diameter of the fine particles, and driving waveforms of n phases or more (n is an integer of 3 or more) are applied to respective electrodes. Incidentally, the term "travelling direction" means a direction of the fine particles moving along the transporting base plate. Also, the term "fine particles" is used to include "particle or granule", "fine particle or granule", "powder", "fine powder", "powder body", "fine powder body" and the like.

Also, according to another aspect of the present invention, there is provided an image formation apparatus comprising: an electrostatic transportation device according to the present invention which has a transporting base plate which transporting fine particles towards a developing section by electrostatic force; an electrostatic transportation device according to the present invention which has a transporting base plate which performs hopping of fine particles in the vicinity of the latent image carrier by electrostatic force; or an electrostatic transportation device according to the present invention which has a transporting base plate which transports fine particles towards a developing section by an electrostatic force; and an electrostatic transportation device according to the present invention which has a transporting base plate which performs hopping of fine particles in the vicinity of an image carrier by an electrostatic force.

According to still another aspect of the present invention, there is provided a development device comprising: an electrostatic transportation device according to the present invention which has a transporting base plate which transporting fine particles towards a developing section by electrostatic force; an electrostatic transportation device according to the present invention which has a transporting base plate in the vicinity of an image carrier by electrostatic force, or an electrostatic transportation device according to the present invention which has a transporting base plate which transports fine particles towards a developing section by an electrostatic force; and an electrostatic transportation device according to the present invention which has a transporting base plate which performs hopping of fine particles by an electrostatic force.

Other objects and features of this invention will become understood from the following description with reference to the accompanying drawings.

DETAILED DESCRIPTIONS

Embodiments of the present invention will be explained below with reference to the drawings. First, a first embodiment of an electrostatic transportation device according to the present invention will be explained with reference to FIGS. 1 and 2. Incidentally, FIG. 1 is a schematic configuration diagram of the electrostatic transportation device and FIG. 2 is an explanatory plan view of a transporting base plate of the electrostatic transportation device.

The electrostatic transportation device has a transporting base plate 1 provided with a plurality of electrodes each generating an electric field which performing transporting and hopping of toner particles which are fine particles, and driving waveforms Pv of n-phases (n is an integer of 3 or more) is applied to the electrodes of the transporting base plate 1 from a driving circuit 2.

Figure 1:
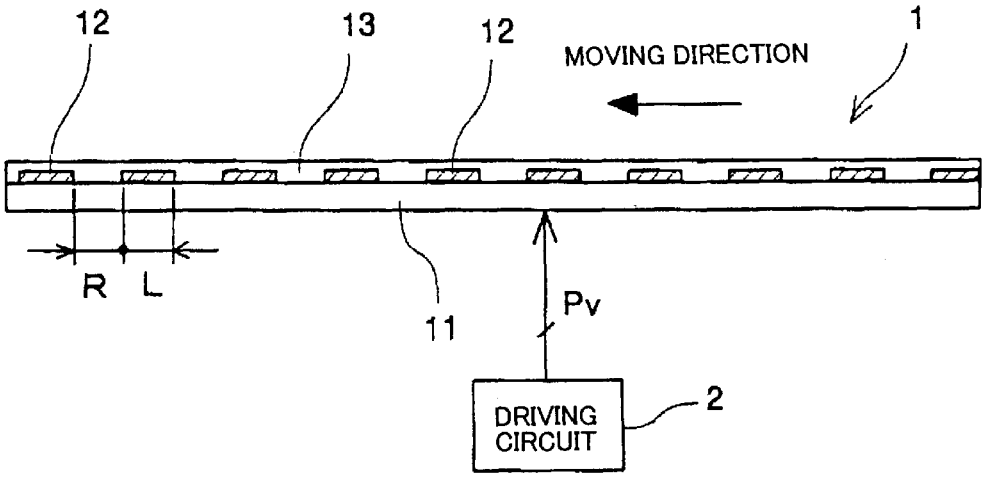
FIG. 1 is a diagram that shows a first embodiment of an electrostatic transportation device according to the present invention.
Figure 2:
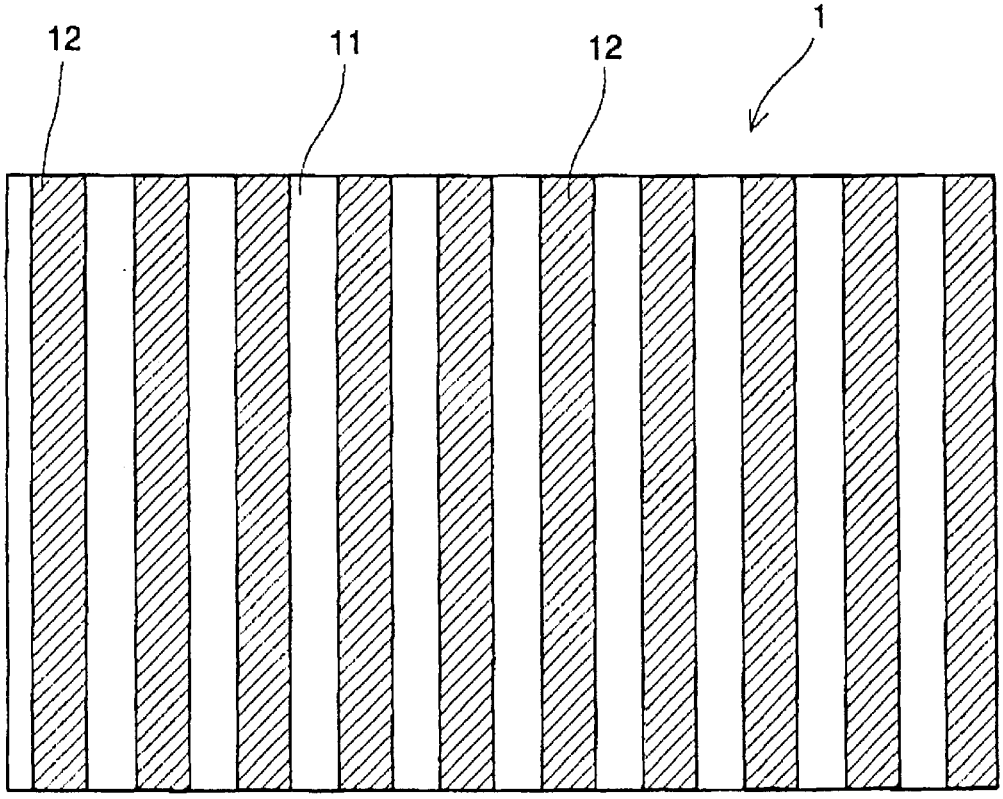
FIG. 2 is a diagram that shows a transporting base plate of the apparatus.

The transporting base plate 1 is structured such that a plurality of electrodes 12, 12, 12, . . . are disposed on a supporting base plate 11 along a fine particles moving direction (a fine particles travelling direction: indicated with arrow in FIG. 1) at predetermined intervals so as to configure a set for each three electrodes, and a surface protecting layer 13 which serves as a transporting face forming member forming an insulating transporting face thereon, which serves as a protective film covering a surface of the electrodes 12 and which is formed from inorganic or organic insulating material is stacked.

Here, as the supporting base plate 11, a base plate made from insulating material, such as a glass base plate, a resin base plate, a ceramic base plate or the like, a base plate obtained by forming an insulating film such as SiO2 or the like on a base plate made of conductive material such as SUS or the like, or a base plate made of flexibly deformable material such as polyimide film, or the like can be used.

The electrodes 12 are formed by forming conductive material such as Al, Ni—Cr or the like on the supporting base plate 11 with a thickness of 0.1 to 0.2 $\mu$m and patterning the formed film to a predetermined electrode shape using a photolithographic process or the like. A width L of each of the plurality of electrodes 12 in the fine particles travelling direction is set to be in a range of 1 time to 20 times of an average particle diameter of the fine particle to be moved, and a interval R between adjacent electrodes 12 and 12 in the fine particles travelling direction is set to be in a range of 1 time to 20 times of the average particle diameter of the fine particles.

The surface protective layer 13 is obtained by forming a film with a thickness of 0.5 to 1 $\mu$m from such a material as, for example, SiO2, TiO2, SiO4, SiON, BN, TiN, Ta2O5 or the like.

In the electrostatic transportation device configured in this manner, by applying driving waveforms of n phases to the plurality of electrodes 12 on the transporting base plate 1 from the direction circuit 2, a phase-shifting electric field (travelling-wave field) is generated by the plurality of electrodes 12 and the charged fine particles on the transporting base plate 1 is applied with a repelling force and/or an attracting force to be subjected to movement including hopping and transporting in the travelling direction.

Figure 3:
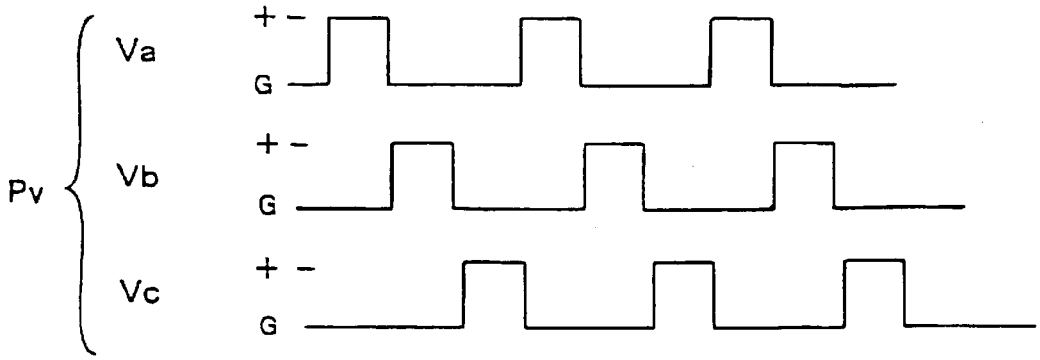
FIG. 3 is a diagram that shows one example of driving waveforms.

For example, pulse-like driving waveforms Va, Vb and Vc varying between ground G and a positive voltage + are applied at different timings from the driving circuit 2 to the plurality of electrodes 12 on the transporting base plate 11, as shown in FIG. 3.

Figure 4:
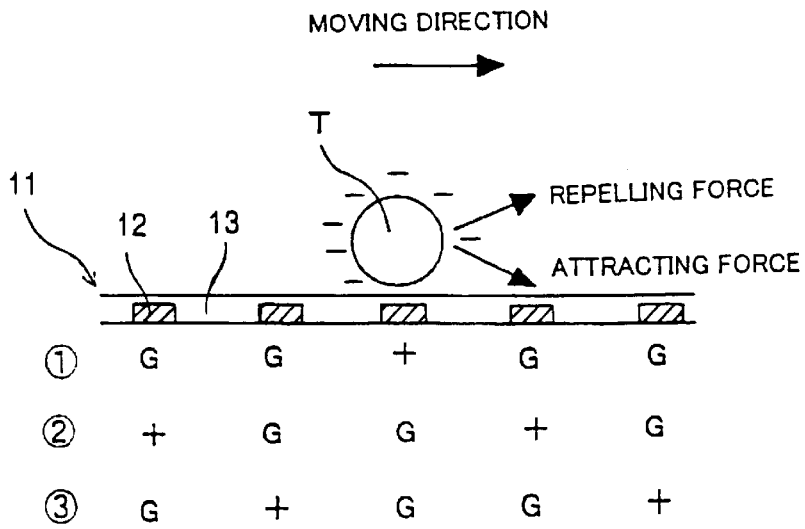
FIG. 4 is a diagram that shows transporting and hopping of fine particles.

At this time, assuming that a negative charged toner T exists on the transporting base plate 11, and "G", "G", "+", "G" and "G" are applied to the plurality of contiguous electrodes 12 on the transporting base plate 11, as shown with 1 in FIG. 4, the negative charged toner T is positioned on the "+" electrode 12.

Since "+", "G", "G", "+" and "G" is respectively applied to the plurality of electrodes 12 at the next timing, as shown with 2 in FIG. 4, and a repelling force between the negative charged toner T and the electrode 12 of "G" on the left side in FIG. 4 and an attracting force between the negative charged toner T and the electrode 12 of "+" on the right side in FIG. 4 acts on the negative charged toner T, the negative charged toner T is moved to the side of the electrode 12 on the "+". Further, since "G", "+", "G", "G" and "+" are applied to the plurality of electrodes 12 at the next timing as shown with 3 in the figure, and similar repelling force and attracting force act on the negative charged toner T, the negative charged toner T is further moved to the side of the electrode 12 of "+".

Thus, since a plurality of phases of driving waveform whose voltage varies are applied to the plurality of electrodes 12, a travelling-wave field is generated on the transporting base plate 1 and the negative charged toner T moves in the travelling direction of the travelling-wave field while being subjected to transporting and hopping. Incidentally, in an instance of a positive charged toner, the positive charged toner moves like the above by reversing a changing pattern of the driving waveform.

In view of the above, the width (electrode width) L of each of the plurality of electrodes 12 on the transporting base plate 11 which performs transporting and hopping of such fine particles, the electrode interval R, the driving waveform shape and the surface protective layer 13 will be explained. The electrode width L and the electrode interval R on the transporting base plate greatly affect a transporting efficiency and a hopping efficiency of the fine particles (herein, which may be referred to as "toner" or "toner particles").

That is, toner particles existing between the electrodes move to the adjacent electrode on the surface of the base plate due to an electric field acting in a generally horizontal direction. On the other hand, since toner particles riding on an electrode are applied with an initial speed having at least vertical component, many toner particles fly apart from the surface of the base plate.

In particular, since toner particles positioned in the vicinity of an end face of the electrode move in a flying manner beyond the adjacent electrode, when the electrode width L is wide, the number of toner particles riding on the electrode increase and the number of toner particles moving over a large distance increases, which results in increase in transporting efficiency. Incidentally, when the electrode width L is too wide, since the field intensity in the vicinity of the center of the electrode lowers, toner particles adhere to the electrode, which results in reduction in transporting efficiency. In view of the above, as the result that the present inventors have studied this matter eagerly, they have found that there is an electrode width suitable for transporting and hopping of fine particles efficiently with a low voltage.

Also, the electrode interval R determines the field intensity between the electrodes on the basis of the relationship between a distance and an applied voltage. As the interval R becomes smaller, the filed intensity is, of course, made stronger, so that initial speeds of transporting and hopping can easily be obtained. However, regarding such a toner particle moving from an electrode to another electrode, the movement distance per one time becomes short. Therefore, unless the driving frequency is made high, the moving efficiency is not improved. As the result that the present inventors have studies this matter eagerly, they have found that there is an electrode interval suitable for transporting and hopping of fine particles efficiently with a low voltage.

Furthermore, the present inventors have found that the thickness of the surface protective layer covering the electrode surface also influences the field intensity of the electrode surface, particularly, influence on lines of electric force of a vertical component is large, which decides the efficiency of hopping.

In view of the above, by setting the relationship among the electrode width, the electrode interval, and the surface protective layer thickness on the transporting base plate properly, the problem about the toner absorption on the electrode surface can be solved and an efficient movement of toner can be performed with a low voltage.

According to more detailed explanation, first, regarding the electrode width L, when the electrode width L is set to be 1 time a toner particle diameter (powder particle size), it is a width size which allows riding, transporting and hopping of at least one toner particle. If the width is narrower than this size, the electric field acting on the toner particle is reduced, and the transporting force and the flying force are lowered, which results in insufficiency for practical use.

Also, as the electrode width L becomes wide, the lines of electric force are inclined to the travelling direction (a horizontal direction) of the transporting base plate, particularly, in the vicinity of the central section on an upper face of the electrode, and a region where a vertical field is weak occurs so that a hopping generating force becomes small. When the electrode width L becomes wide excessively, in an extreme instance, an attracting force due to an image force corresponding to the charge of the toner particle, van der Waals force, water content or the like becomes higher than a repelling force, so that deposition of toner particles occurs in some instances.

In view of efficiencies of transporting and hopping, when the electrode has its width which allows about 20 toner particles ride on the electrode, absorption becomes difficult to occur and actions of transporting and hopping are made possible efficiently with a driving waveform of a low voltage of about 100V. When the width is wider than the above size, a region where a partial absorption is generated occurs. For example, when an average particle diameter of a toner particle is 5$\mu$, the value of 5 $\mu$P corresponds to a range of 5 $\mu$m to 100 $\mu$m.

A more preferable range of the electrode width L is 2 times to 10 times the average particle diameter of the fine particles in order to drive the toner particles more effectively with a low voltage of 100V or less set as the application voltage of the driving waveform. By setting the electrode width L within the range, lowering of the field intensity in the vicinity of the central section on the surface of the electrode is suppressed to ⅓ or less, and the lowering of the hopping efficiency becomes 10% or less, so that the efficiency is prevented from being lowered largely. This corresponds to the range of 10 $\mu$m to 50 $\mu$m, when the average particle diameter of toner particles is 5 $\mu$m, for example.

Furthermore, it is more preferable that the electrode width L is in a range of 2 times to 6 times the average particle diameter of the fine particles. This corresponds to the range of 10 $\mu$m to 30 $\mu$m, when the average particle diameter of toner particles is 5 $\mu$m, for example. It has been found that a very high efficiency is achieved by setting the average particle diameter within the range.

Figure 5:
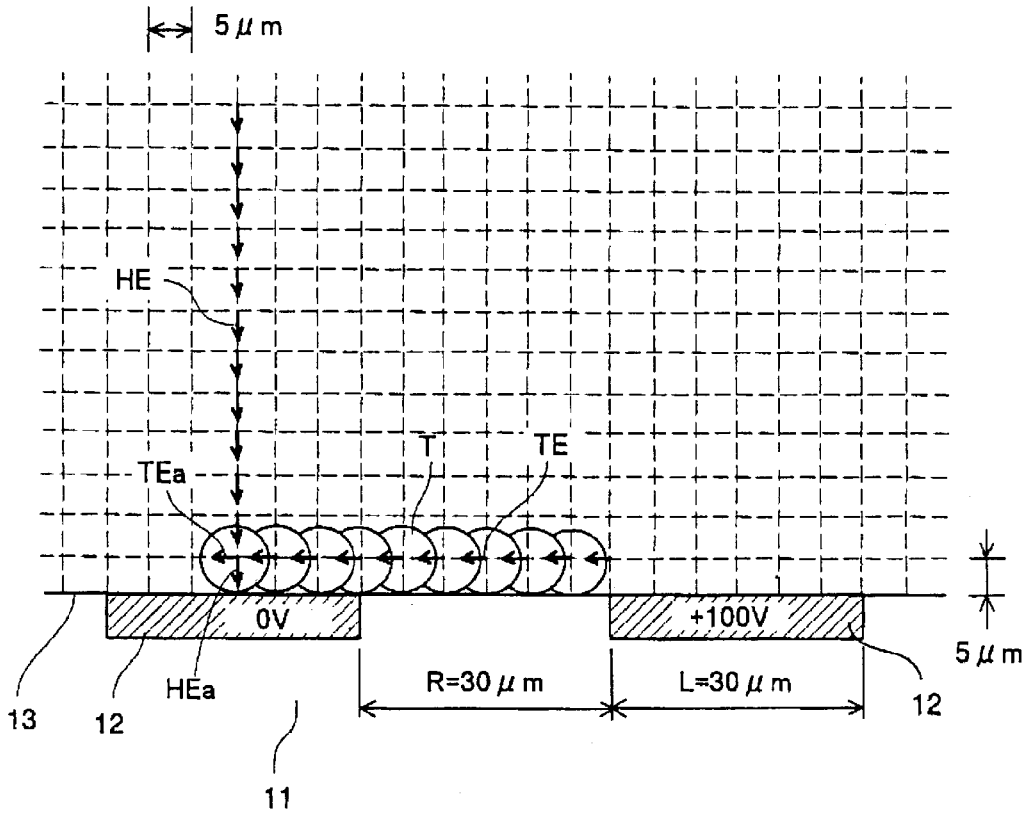
FIG. 5 is a diagram that shows an electrode width and a interval between electrodes.
Figure 6:
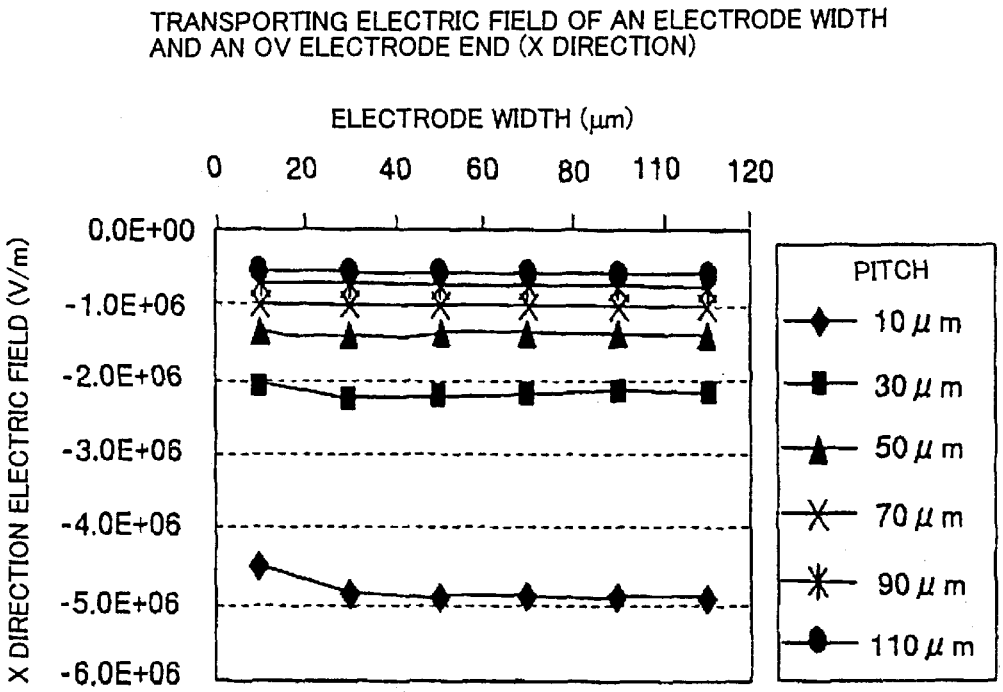
FIG. 6 is a graph that shows one example of a relationship between the electrode width and an electric field at an electrode end of 0V (X direction)
Figure 7:
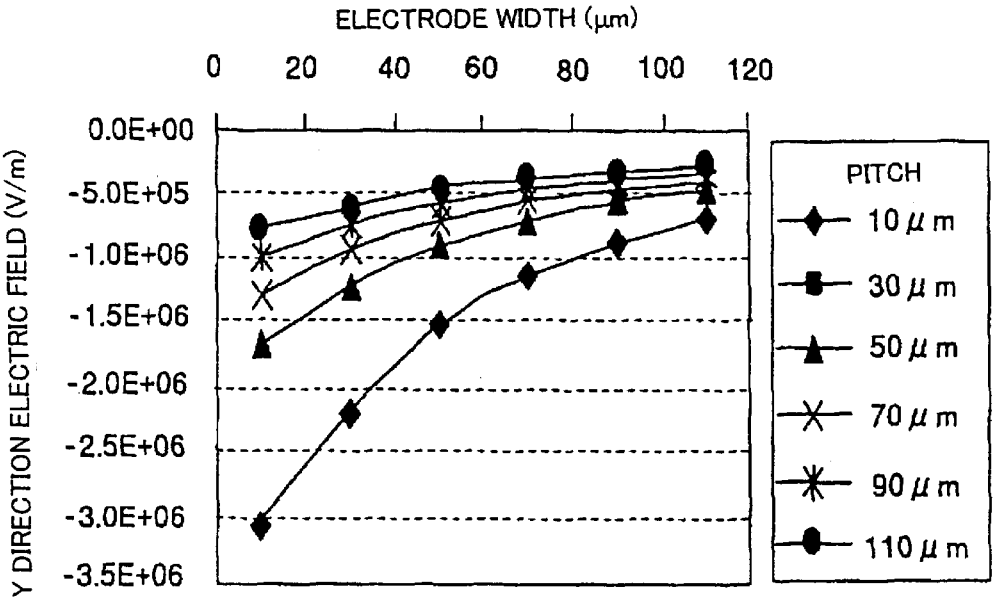
FIG. 7 is a graph that shows one example of a relationship between the electrode width and an electric field at an electrode end of 0V (Y direction)

Here, the results obtained by measuring the intensities of the transporting electric field TE and the hopping electric field HE to the electrode width L and the electrode interval R in a state that the width (electrode width) L of each electrode 12 on the transporting base plate 11 is set to 30 $\mu$m, the electrode interval R is set to 30 $\mu$m, the thickness of the electrode 12 is set to 5 $\mu$m, the thickness of the surface protective layer 13 is set to 0.1 $\mu$m, and +100V and 0V are respectively applied to two adjacent electrodes 12 and 12, as shown in FIG. 5, are shown in FIGS. 6 and 7.

Incidentally, each evaluation data is directed to a result obtained by evaluating a simulation and a behavior of a particle captured by a high speed video actually. In FIG. 5, two electrodes 12 are shown for an easy understanding of the details, but a region where a sufficient number of electrodes are provided is evaluated in actual simulation and experiment. Also, the particle diameter of the toner particle T is 8 $\mu$m and the amount of charge is −20 $\mu$C/g.

Field intensities shown in FIGS. 6 and 7 are the values of representative points on the electrode surface, where the representative point TEa of the transporting electric field TE is a point positioned above the end section of the electrode end section shown in FIG. 5 by 5 $\mu$m and the representative point HEa of the hopping electric field HE is a point of the electrode shown in FIG. 5 by 5 $\mu$m, these points corresponding to the representative points where the strongest electric fields act on a toner particle in an X direction and a Y direction.

From FIGS. 6 and 7, it is found that, an electric field which can apply a force acting for transporting and hopping of a toner is in a range of (5E+5)V/m or more, a preferable electric field which does not cause the problem about the absorption is in a range of (1E+6)V/m or more, and a more preferable electric field which can apply a sufficient force to a toner is in a range of (2E+6) V/m or more.

Regarding the electrode interval R, according to increase in the interval, the field intensity in the transporting direction is lowered. Therefore, the electrode interval is 1 time to 20 times the average particle diameter of the toner particle, preferably 2 times to 10 times, further preferably 2 times to 6 times, as described above.

From FIG. 7, the hopping efficiency is lowered according to increase in width of the electrode interval R, but a practical hopping efficiency can be obtained in a range of up to 20 times the average particle diameter of the toner particle. When the electrode interval R exceeds 20 times the average particle diameter of the toner particle, the attracting force of many toner particles can not be disregarded, so that toner(s) which is not subjected to hopping occurs. In this point, therefore, it is also necessary to set the electrode interval R to 20 times or less of the average particle diameter of toner particles.

As mentioned above, the field intensity in the Y direction is determined according to the electrode width L and the electrode interval R, where the field intensity is increased as the width and the interval are made smaller. Also, the field intensity near to the electrode end section in the X direction is determined according to the electrode interval R, where the field intensity is made stronger as the interval is made smaller.

Thus, by setting the width of the electrode in the travelling direction of the fine particles within the range of 1 time to 20 times of the average particle diameter of the fine particles and setting the interval of the electrode in the travelling direction of the fine particles within the range of 1 time to 20 times, an electrostatic force sufficient to overcome attracting force such as image force, van der Waals force, and the like to the charged powder particles on the electrode or between the electrodes to perform transporting and hopping of the powder particles can be caused to act on the powder particles so that the powder particles are prevented from being stayed and the transporting and hopping thereof can be performed stably and efficiently with a low voltage.

According to the present inventors' investigation, in instance that the average particle diameter of toner particles is in a range of 2 to 10 $\mu$m and Q/m in a negative charged toner particle is in a range of −3 to −40 $\mu$C/g, more preferably −10 to −30 $\mu$C/g $\mu$, or Q/m in a positive charged toner particle is in a range of +3 to +40 $\mu$C/g, more preferably +10 to +30 $\mu$C/g$\mu$, the transporting and hopping in the above-described electrode configuration could have been performed efficiently.

Figure 8:
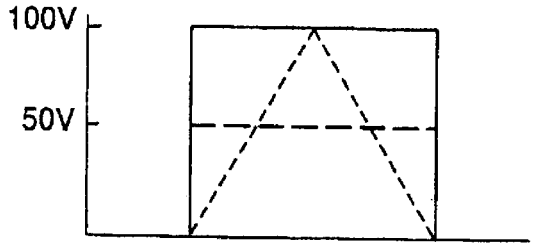
FIG. 8 is a diagram that shows a waveform of a driving waveform.

Next, a waveform about a driving waveform applied to each electrode on the transporting base plate will be explained. The results obtained by measuring initial positions of a toner particle and horizontal movement distances in a predetermined time (is set to 160 $\mu$sec) in an instance that the average particle diameter of toner particles is 8 $\mu$m and Q/m is −20 $\mu$C/g in the configuration shown in FIG. 5, and, as shown in FIG. 8, in respective instances where a rectangular wave (pulse-shaped) driving waveforms (using a waveform of the maximum voltage of 100V and a waveform of the maximum voltage of 50V) are applied and where a triangular wave driving waveform (using a waveform of the maximum voltage of 100V) are applied shown in FIG. 9.

Figure 9:
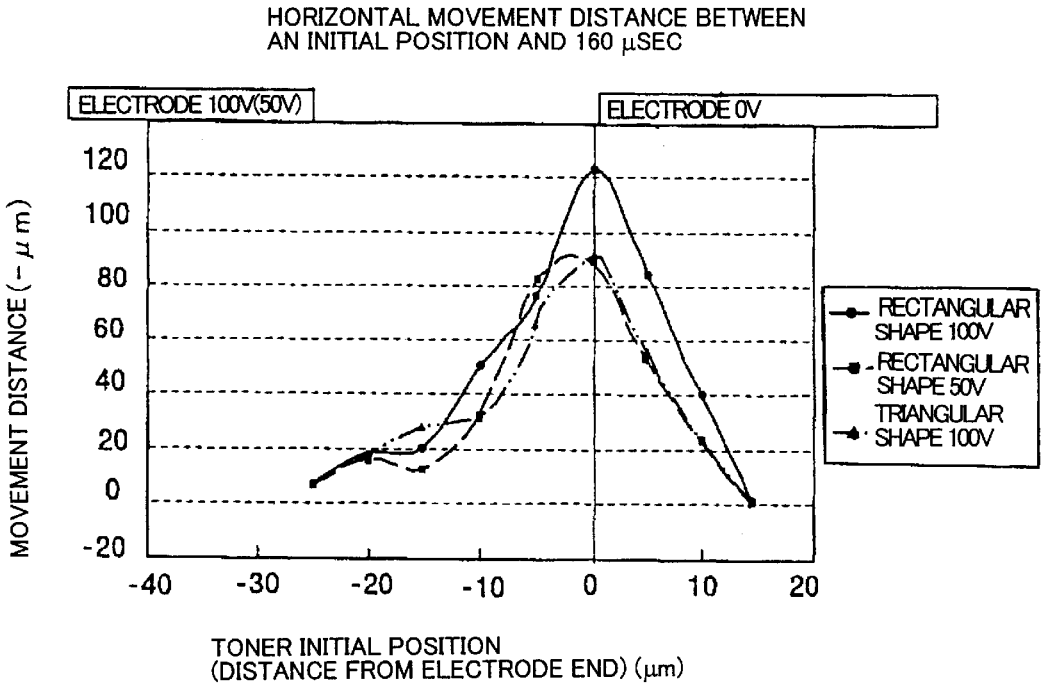
FIG. 9 is a graph that shows a relationship between a waveform of a driving waveform and a horizontal movement distance.

As understood from FIG. 9, even if the same rectangular driving waveform is applied, the movement distance in the rectangular wave driving waveform of 50V becomes shorter than that in the rectangular wave driving waveform. Also, an instance of a triangular wave driving waveform having a leading edge and trailing edge of 80 $\mu$sec becomes equivalent to an instance of application of the rectangular wave driving waveform of 50V.

That is, as an field intensity acting as actions of transporting and hopping, an field intensity in the vicinity of the base plate, which decides an initial speed becomes important to a toner particle on the transporting base plate. In other wards, after a toner separates from the vicinity of the surface of the base plate, even when the voltage applied to the electrode rises and the field intensity increases, the field intensity does not contribute to an action of transporting or hopping, which results in lowering of efficiency.

For example, when the average speed of a toner particle accelerated to fly is 0.3 to 1 m/sec, the field intensity lowers ⅕ and a time taken for a move over a distance of 30 $\mu$m becomes 100 to 30 $\mu$m. Therefore, in this instance, when the time constant of an application voltage of a driving waveform is in a range of 100 to 30 $\mu$VHF, an initial speed can be achieved, which allows transporting and hopping actions.

Figure 10:
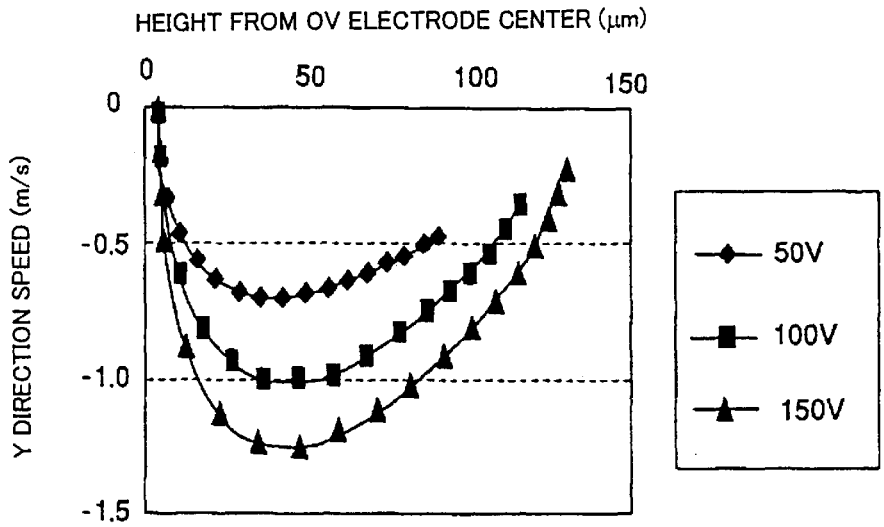
FIG. 10 is a graph that shows one example of a relationship in voltage of a driving waveform between a Y-direction speed and a hopping height.

Also, the result obtained by measuring toner speeds (hopping speeds) in a hopping direction regarding the toner whose average particle diameter is 8 $\mu$m and whose Q/mis −20 $\mu$C/g in the configuration shown in FIG. 5 when rectangular wave driving waveforms whose voltage crest values are 50V, 100V and 150V are applied is shown in FIG. 10. This indicates a speed change at 10 $\mu$sec per one step and the height position from the electrode. From this result, after the predetermined time period (160 $\mu$sec), since the toner is positioned at a height of 100 $\mu$m or more, an application to developing process or the like can be made possible.

Incidentally, the driving waveform is not limited to the rectangular wave (pulse-shaped) driving waveform, but transporting and hopping actions can be performed even by a driving waveform having a time constant such as a triangular wave or the like. Also, even using a sine wave corresponding to the similar time constant as the driving waveform, practical transporting and hopping actions can be performed.

Next, the surface protective layer 13 will be explained. By providing a surface protective layer, an electrode is prevented from being soiled and being adhered with fine particles or the like, the surface of the transporting base plate can be maintained in conditions suitable for transportation, a creepage leak can be avoided in a high moisture environment, Q/M is prevented from varying, and the amount of charge of the fine particles can be maintained stable.

Figure 11:
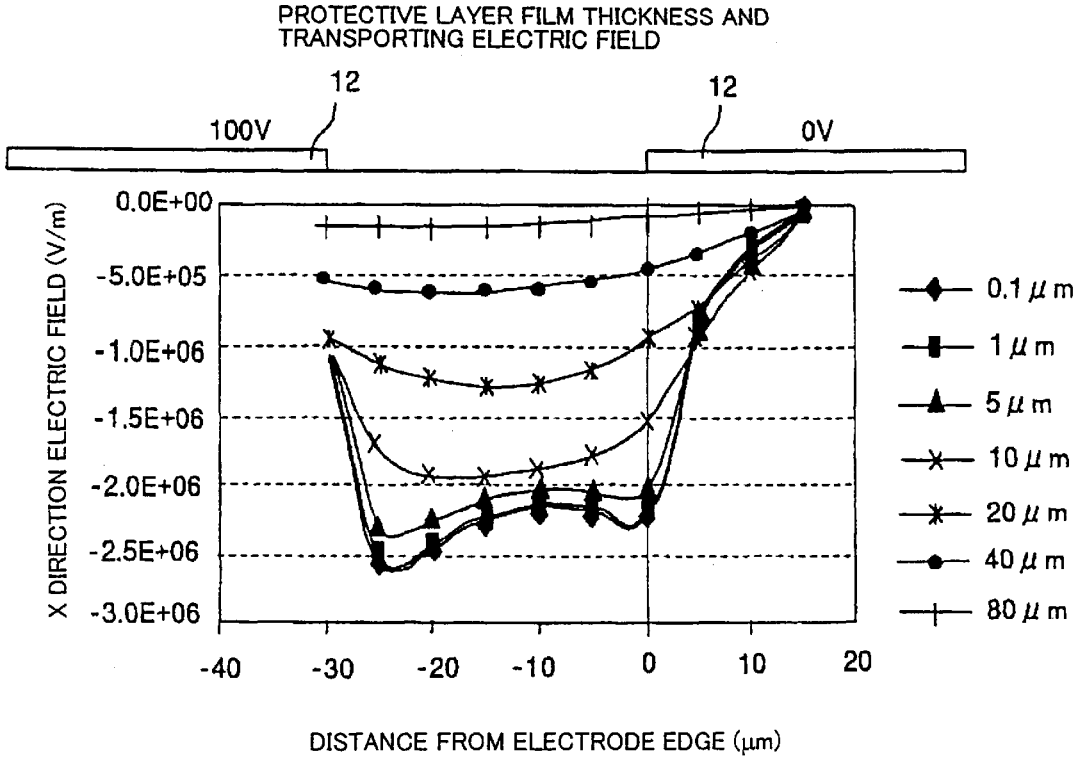
FIG. 11 is a graph that shows one example of a relationship between a film thickness of a surface protecting layer and a field intensity.

Here, the result obtained by calculating the field intensity in the X direction when the thickness of the surface protective layer is changed in a range of 1 to 80 $\mu$m in the configuration shown in FIG. 5 is shown in FIG. 11.

The dielectric constant $\in$ of the surface protective layer is higher than that of air, ordinarily, $\in$=2 or more. As understood from FIG. 11, when the thickness (the thickness measured from the electrode surface) of the surface protective layer is too thick, the field intensity acting on toner particles on the surface is lowered. Taking the transporting efficiency, temperature resistance and moisture proof environments or the like in consideration, a practical surface protective layer thickness which does not cause the problem about the efficiency lowering to transporting action is 10 $\mu$m or less which causes an efficiency lowering of 30%, more preferably 5 $\mu$m or less which suppresses the efficiency lowering to several %.

Figure 12A:
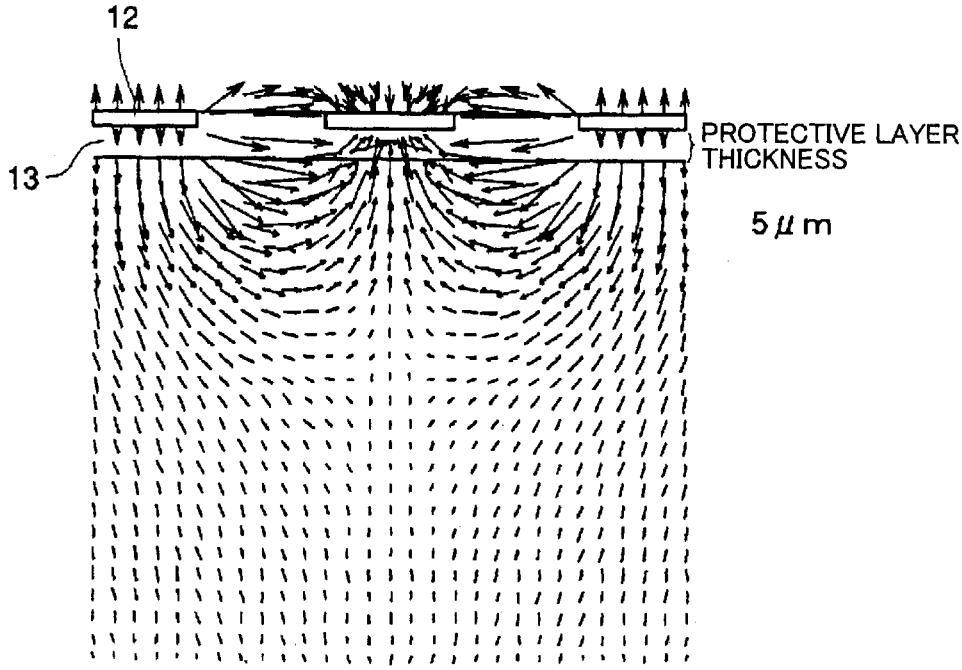
FIGS. 12A and 12B are diagrams which show relationships between a film thickness of a surface protecting layer and a field intensity, respectively.
Figure 12B:
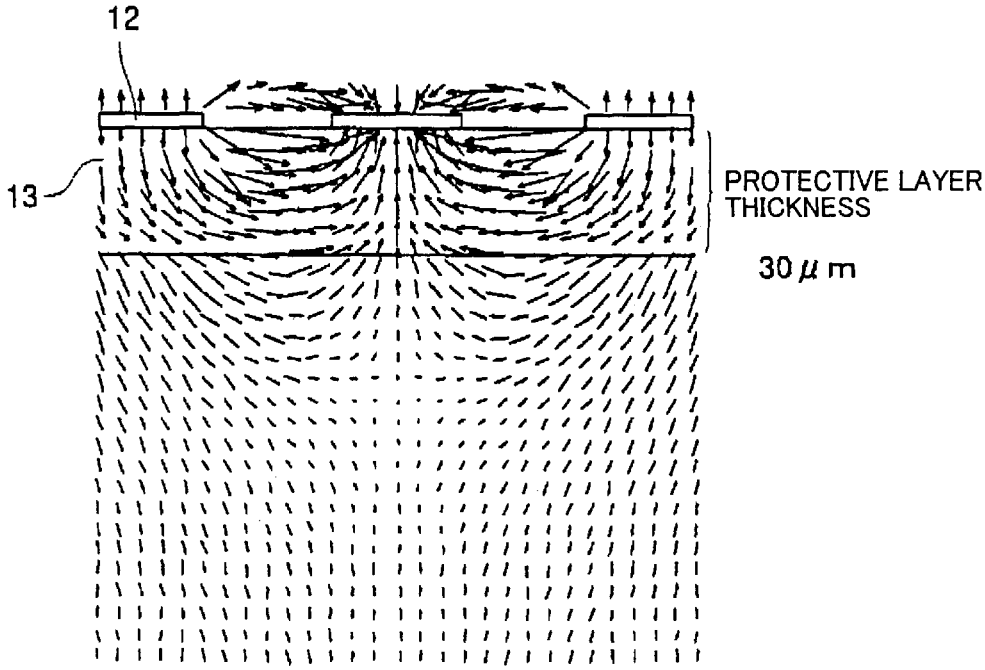

Also, examples of field intensities acting on hopping on an electrode surface are shown in FIG. 12*a* and FIG. 12*b*. FIG. 12*a* shows an example where the thickness of the surface protective layer is 5 $\mu$m, and FIG. 12*b* shows an example where the thickness of the surface protective layer is 30 $\mu$m. In both the examples, the electrode width is set to 30 $\mu$m, the electrode interval is set to 30 $\mu$m, and the application voltages are set to 0V and 100V.

As understood from these figures, since electric field from a protective layer with a dielectric constant higher than that of air towards an adjacent electrode increases according to increase in thickness of the surface protective layer, a vertical component of the electric field on the surface decreases and the field intensity acting on the toner on the surface lowers by the thickness of the protective layer.

That is, lines of electric force of the vertical component acting for a hopping depends on the protective layer thickness largely. The electric field which can apply a force acting for a hopping at a low voltage of about 100V efficiently to toner particles is preferably in a range of (1 E+6)V/m or more which does not cause the problem about absorption, more preferably in a range of (2E+6)V/m or more which allows a further sufficient force to the toner. In order to achieve such electric field, the protective layer thickness should be set to 10 μm or less, preferably 5 μm or less.

Incidentally, as material for the surface protective layer, it is preferable to use material whose resistivity is 10*E6 Ωcm or more and whose dielectric constant ∈ is 2 or less.

Thus, by providing a surface protective layer covering the electrode surface and setting the thickness of the surface protective layer to 10 μm or less, the electric field of the vertical component can be caused to act on fine particles strongly and the hopping efficiency can be enhanced.

Next, the thickness of the electrode 12 will be explained. As described above, when a surface protective layer with a thickness of several μP covering the electrode surface is formed, undulation occurs on the transporting base plate surface corresponding to regions where an electrode exists under the surface protective layer and where an electrode does not exist thereunder. At this time, by forming the electrode in a thin layer with a thickness of 3 μm or less, the fine particles which a particle size of about 5 μP such as toner particles or the like can be transported smoothly without causing the problem about the undulation occurring on the protective layer surface. Therefore, when the electrode is formed in a thickness of 3 μm or less, a transporting base plate having a thin surface protective layer can be put in practical use without requiring such a process as a flattening process on a transporting base plate surface, and the field intensity for transporting and hopping is prevented from lowering so that more efficient transporting and hopping can be achieved.

Now, a specific example of such a transporting base plate will be explained. When the electrostatic transportation device according to the present invention is used in an image formation apparatus, as a transporting base plate for transportation and a hopping, it is required to implement fine patterning on an elongated and large area with at least A4 size of a length of 21 cm or a width of 30 cm or more. For this reason, it is preferable that a thin electrode, a thin protective film (surface protective layer) are sequentially laminated on a base material (supporting member) which serves as a base.

First, as one example of a transporting base plate having flexible fine pitch thin layer electrodes, using a polyimide base film (thickness of 20 to 100 μm) as the base member (supporting base plate 11), a film of Cu, Al, NiCr or the like with a thickness of 0.1 to 0.3 μm is formed on the base material by vapor deposition process. When the film thus formed has a width of 30 to 60 cm, such a transporting base plate can be manufactured in a roll-to-roll apparatus, so that a mass productivity can be greatly enhanced. A common bus line forms electrodes with a width of 1 to 5 mm simultaneously.

As a specific unit for the vapor process, there are various processes such as a sputtering process, an ion-plating process, a CVD process, an ion beam process, and the like. For example, in an instance of forming electrodes by the sputtering process, a Cr film can be interposed in order to improve adhesion with polyimide. Also, the adhesion can be improved even by a plasma process or a primer process with Ni film thickness of 1 to 3 μm.

Also, as a process other than the vapor deposition process, thin layer electrodes can be formed even by an electrodeposition process. In this instance, electrodes are formed on the polyimide base member by an electrode plating. After the base member is sequentially dipped in a Sn chloride bath, a Pd chloride bath, and a Ni chloride bath to form substrate electrodes thereon, an electroplating is performed on the electrodes in Ni electrolyte so that the thin film electrodes can be manufactured in the roll-to-roll process.

The electrodes are formed by applying resist coating, patterning and etching to these thin film electrodes. In this instance, when the thin layer electrodes have a thickness of 0.1 to 3 μm, fine pattern electrodes with a width or pitch of 5 μm to several tens pm can be formed by a photolithography process and an etching process with a high precision.

Next, as the surface protective layer 13, SiO2, TiO2 or the like with a thickness of 0.5 to 2 μm is formed by a sputtering process. Alternatively, as the surface protective layer, PI (polyimide) is coated by a roll coater or another coating apparatus with thickness of 2 to 5 μm and it is finished by baking the same. When it causes a drawback that the PI is left as it is, SiO2 or another inorganic film with a thickness of 0.1 to 0.5 μm may be formed on the outermost surface by a sputtering process or the like.

By configuring such a flexible transporting base plate, the base plate can be attached to a cylindrical drum or it may be partially formed in a curved shape easily.

Also, as anther example, using a polyimide base film (with a thickness of 20 to 100 μm) as the base member (supporting base plate 11), it is possible to employ a film of Cu, SUS or the like with a thickness of 10 to 20 μm to the base member as electrode material. In this instance, polyimide is coated on a metal material in a thickness of 20 to 100 μm by a roll coater and baked. Thereafter, the metal material is patterned in a shape of the electrodes 12 by a photolithography process and an etching process, and polyimide is coated on the surfaces of the electrodes 12 as the protective layer 13. When there is undulation corresponding to the thickness of 10 to 20 μm of the metal material electrode, the transporting base plate is completed by flattening the protective layer 13.

For example, by performing a spin coating of polyimide base material or polyurethane base material with a viscosity of 50 to 10,000 cps, preferably 100 to 300 cps, and leaving it as it is, the undulation on the surface is smoothed owing to a surface tension of the material so that outermost surface of the transporting base plate is flattened.

Furthermore, as another example of the flexible transporting base plate whose strength is enhanced, using SUS, Al material with a thickness of 20 to 30 μm or the like as the base member, diluted polyimide material is coated in a thickness of about 5 μm on the base member as an insulating layer (insulation between the electrodes and the base member) by a roll coater. Then, for example, the polyimide is pre-baked at 150° C. for 30 minutes and post-baked at 350° C. for 60 minutes, in which a thin film polyimide film is formed to provide the supporting base plate 11.

Then, after a plasma process or a primer process is performed in order to enhance the adhesion, NiCr is vapor-deposited in a thickness of 0.1 to 0.2 μm as a thin layer electrode layer and fine patterned electrodes 12 with a width of several tens μm are formed by a photolithography and an etching process. Further, the surface protective layer 13 of SiO2, TiO2 or the like is formed in a thickness of 0.5 to 1 μm on the surfaces of the electrodes by sputtering so that a flexible transporting base plate can be obtained.

In this example, in instance that the flexible transporting base plate is wound on a cylindrical drum, the same material as that of the cylindrical drum or material whose coefficient of linear expansion is approximately coincident with that of the cylindrical drum is used as the metal material which serves as the base member of the transporting base plate, so that a problem about expansion and contraction due to a temperature generated according to a difference in linear expansion between the transporting base plate and the cylindrical drum can be prevented from occurring. Also, when the transporting base plate is used in a developing section of the image formation apparatus, it is possible to use SUS material or Al material of the base member as a biasing electrode serving between the transporting base plate and a photosensitive body.

By configuring such a flexible transporting base plate, the degree of freedom where the base plate is wound on a cylindrical drum or it is partially bent and used is increased and a mass production in a roll-to-roll can be achieved, so that it is possible to easily manufacture a transporting base plate having accurate fine pitch electrodes at a low cost.

Incidentally, even in each of the examples, since a travelling-wave electric field is used, a contact between each electrode and a common electrode is required. Regarding two phases, both electrodes therefore are simultaneously formed. However, in an instance of a three phase electric field, for example, regarding one phase, a bridge pattern may be formed in an interposing manner via an insulation layer.

Next, a relationship between a polarity of charged fine particles to be moved and the material of the outermost layer of the surface protective layer will be explained. Incidentally, when the surface protective layer is a single layer, the outermost layer of the surface protective layer means the single layer, and when the surface protective layer comprises a plurality of layers, it means a layer forming a surface coming into contact with the fine particles.

When toner used in an image formation apparatus is transported, styrene-acryl base copolymer, polyester resin, epoxy resin, polyol resin or the like is used as resin material occupying 80% or more of toner, taking in consideration a melting temperature, a transparency in color or the like. The charge characteristic of the toner is influenced by these resins, but a charge controlling agent is added for the purpose of controlling an amount of charge positively. As a charge controlling agent for black toner (BK), for example, nigrosine base dye or fourth grade ammonium salts is used in an instance of positive charge, while, for example, azo-base metallic complex or salicylic acid metallic complex is used in an instance of negative charge. Also, as a charge controlling agent for color toner, for example, fourth grade ammonium salts or imidazole base complexes are used in an instance of positive charge while, for example, salicylic acid metallic complexes or salts, or organic boron salts is used in an instance of negative charge.

On the other hand, since these toner particles are transported on the transporting base plate by the phase-shifting field (travelling-wave electric field) or they repeat contact with the surface protective layer and separation therefrom by action of hopping, the toner particles are influenced by friction electrification, but the amount of charge and the polarity of the toner particles are determined according to the charge sequence among the materials.

In this instance, by maintaining the charge amount of the toner in a saturated charge amount which is mainly determined by the charge controlling agent or a charge amount which is slightly reduced therefrom, efficiencies for transportation, a hopping and a photosensitive development can be improved.

When the charge polarity of the toner is negative, it is preferable that a material positioned in the vicinity of the material used as the charge controlling agent for toner on a frictional electrification sequence (an instance of a reduced transporting and hopping region) or a material positioned on a positive end side of the sequence is used as the material for a layer forming at least the outermost surface of the surface protective layer. For example, when the charge controlling agent is the salicylic acid metallic complex, the material in the vicinity of the salicylic acid metallic complex, or polyamide 66, polyamide 11, SiO or the like is used.

Also, when the charge polarity of the toner is positive, it is preferable that a material positioned in the vicinity of the material used as the charge controlling agent for toner on the frictional electrification sequence (an instance of a reduced transporting and hopping region) or a material positioned on a negative end side of the sequence is used as the material for a layer forming at least the outermost surface of the surface protective layer. For example, when the charge controlling agent is the fourth grade ammonium salts, the material in the vicinity of the fourth grade ammonium salts, or Teflon base material such as fluorine or the like is used.

Figure 13:
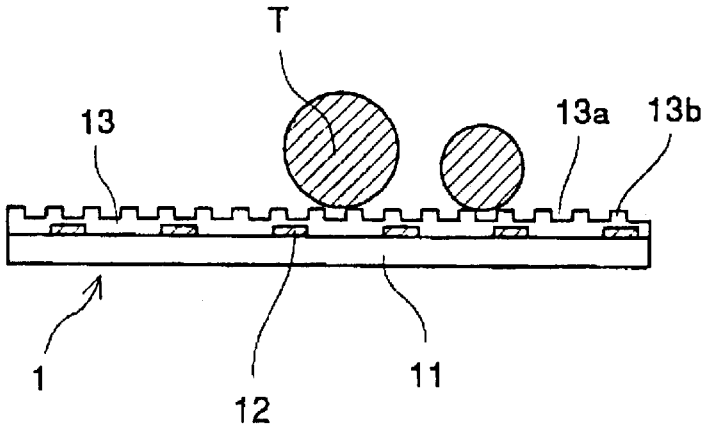
FIG. 13 is a diagram that shows a coarsening process for a surface protecting film.

Next, coarsening process of the outermost surface of the surface protective layer of the transporting base plate will be explained with reference to FIG. 13. Here, as shown in this figure, the outermost surface of the surface protective layer 13 is formed in an undulation face by performing a coarsening process on the surface of the surface protective layer 13 to form concave sections 13*a* and concave sections 13*b*. This coarsening process forms a observed undulation surface by performing a photolithography and a wet etching, or a photolithography and a dry etching after the surface protective layer 13 is formed. Alternatively, the surface of the surface protective layer 13 itself is formed in a flat face, particles which undulates forming are coated on the flat face, or a sheet film which undulates forming is attached thereon so that the undulation face can be formed.

In this instance, it is preferable that undulation is formed in ½ or less of a size or diameter of the fine particle. Thereby, the number of undulations which have a height of ½ or less of the diameter of fine particle, which is 4 times or more the number of fine particles covering the surface of the base plate in one layer is formed. Incidentally, the undulation can be formed in a line shape or in a dot matrix shape in a direction of movement of fine particles, in a direction crossing this direction, or in the movement direction and the crossing direction.

Thus, by coarsening the outermost surface of the surface protective layer, the contact area of the charged fine particles with the protective layer can be reduced, so that the attracting force of the fine particles to the base plate can be suppressed to a lower level and such a problem is solved that the fine particles are deposited on the electrodes. As a result, improvement of the transporting and hopping efficiency can be achieved.

Next, a voltage application time per one phase of the driving waveform and the voltage application duty will be explained with reference to FIGS. 14 to 16. Regarding the relationship between the polarity of voltage applied to the electrodes and the movement direction of the charged toner (fine particles), when the toner is negative-charged and the application voltage is in a range of 0 (G) to +voltage, the toner flies in a direction opposed to the line of electric force from the electrode applied with +voltage towards the electrode applied with 0V. Also, when the toner is positive-charged, the toner flies in the same direction of the line of electric force.

Figure 14:
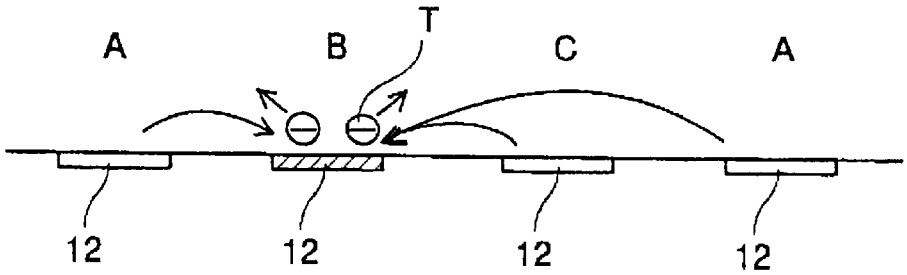
FIG. 14 is a diagram that shows a voltage application time and voltage application duty of a driving waveform.

Here, FIG. 14 is to explain a behavior of a toner particle to an application voltage pulse duty with attention to the toner on an electrode (B electrode) applied with a B-phase (driving waveform Vb). When there is a negative charged toner particle T attracted while the voltage of the B-phase electrode is maintained in +voltage, the toner particle T starts flying towards a line of electric force directing from the electrode of +voltage to the B-phase electrode at a time when the voltage of the B-phase electrode has been switched to 0V.

At this time, in instance that a travelling-wave electric field is generated by applying pulse-like voltages (driving waveforms) of n phases (n is an integer of 3 or more) to each electrode, the +voltage application duty of the application voltage pulse is set to a voltage application duty where a voltage application time per one phase is less than [cycle period time×(n−1)/n] so that the efficiency of transporting and hopping can be increased.

Figure 15:
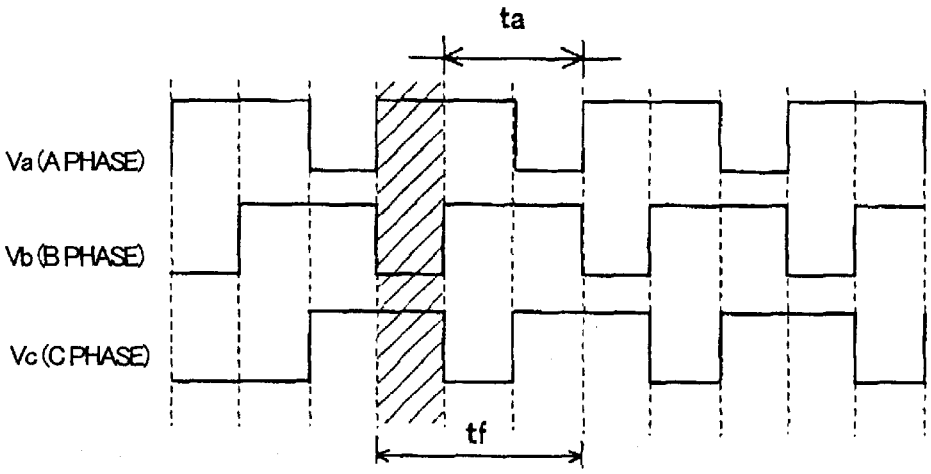
FIG. 15 is a diagram that shows one example of a driving waveform where a voltage application duty is about 67%.

That is, for example, as shown in FIG. 15, in instance that an application of a driving waveform of three phases of A, B and C is performed and a voltage application time ta of each phase is set to ⅔ of a cycle period time tf which is about 67%, the A phase becomes +voltage and the C phase also becomes +voltage when the B phase becomes 0V. Therefore, viewing the A-phase electrode, the B-phase electrode and the C-phase electrode arranged as shown in FIG. 14, a symmetrical field distribution regarding the B-phase electrode can be obtained.

For this reason, a toner particle positioned on a front half section, in a travelling direction of the particle, on the B-phase electrode is moved in a normal direction of transporting and hopping, but another toner particle positioned on a rear half section of the electrode starts moving just in a direction opposed to the normal direction, which results in remarkable lowering of the efficiency. Therefore, when the driving waveform of three phases is used, the efficiency can be prevented from lowering by setting the voltage application time ta of each phase to less than 67% of the cycle period time tf which is ⅔ thereof. When a driving waveform of four phases is used, the efficiency can be prevented from lowering like the above by setting the voltage application time of each phase to less than 75% of the cycle period time which is ¾ thereof.

Figure 16:
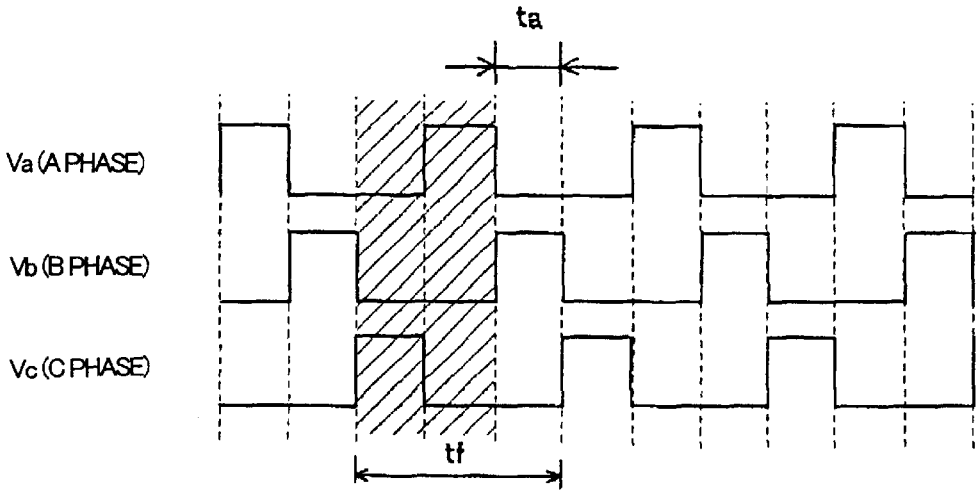
FIG. 16 is a diagram that shows one example of a driving waveform where a voltage application duty is about 33%.

Furthermore, for example, as shown in FIG. 16, in instance that an application of a driving waveform of three phases of A, B and C is performed and a voltage application time ta of each phase is set to ⅓ of a cycle period time tf which is about 33%, namely, in instance that [cycle period time/n] is set, a voltage applied to the A-phase electrode is 0V and a voltage applied to the C-phase electrode is +voltage at a time when a voltage applied to the B-phase electrode has become 0V, and the travelling direction of the fine particles is A→C, when viewed with attention to the B-phase electrode. Therefore, the toner on the B-phase electrode is subjected to an electric field acting in a direction where it is repelled from the A-phase electrode and it is attracted to the C-phase electrode, so that the transporting and hopping efficiency is enhanced.

In other words, the efficiency can be improved by setting such a time that, between a voltage applied to a observed electrode and each of voltages applied to an adjacent electrode on an upstream side of the travelling direction and an adjacent electrode on a down stream side thereof, the upstream side adjacent electrode repels the observed electrode and the downstream side adjacent electrode attracts the observed electrode. Particularly, when the driving frequency is high, by setting the time within a range of [cycle period time/n] to less than [cycle period time×(n−1)/n], an initial velocity for a toner on the observed electrode can easily be obtained, so that repetition of transportation can be improved without reduction in efficiency, particularly, a high speed transportation can be performed.

Also, in order to perform transporting and hopping action efficiently, it is important to apply at least predetermined initial velocity to fine particles (toners) on the transporting base plate, and therefore a field intensity required for toners on the transporting base plate is caused to act on the toners. The required intensity is an electric field which overcomes an attracting force such as an image force, a van der Waals force or the like according to the charge of toner to fly each toner particles.

As described above, the electric field which can apply a force acting for transportation and hopping of toner particles to the toner particles is at least (5E+5)V/m, a preferable electric filed which does not cause the problem about the absorption is at least (1E+6)V/m, and a more preferable electric field which can apply a sufficient force to toner particles is at least (2E+6)V/m. When a toner particle which has been imparted with a speed by this electric field is moved up to a distance where the toner particle is not influenced by this field, even if the relationship where the upstream side adjacent electrode (A-phase electrode) relative to the observed B-phase electrode is 0V and the downstream side adjacent electrode (C-phase electrode) is +voltage is collapsed, which does not influence the transporting and hopping efficiency so much.

For example, when a voltage of 100V is applied, the electric field hardly influences a space separated from the electrode upward by 50 μm. Also, the field intensity in a space separated from the electrode surface upwardly by 30 μm is reduced to ⅕ of the original field intensity. Therefore, when an average velocity of a toner particle accelerated to fly is in a range of 0.3 to 1 m/sec, the time required for a toner particle to move over a distance of 30 μm where the field intensity lowers to ⅕ thereof becomes 100 to 30 μsec.

Now, regarding the time when a voltage which repels fine particles is applied to the electrode of the observed phase, and the time when a voltage which repels the fine particles is applied to the upstream side adjacent electrode and simultaneously therewith a voltage which attracts the fine particle is applied to the downstream side adjacent electrode, in the example shown in FIG. 14, the time when the upstream side adjacent electrode (A-phase electrode) relative to the observed B-phase electrode is 0V and the downstream side adjacent electrode (C-phase electrode) is +voltage is set to at least 30 μsec. This constitutes the condition of a narrow side of +voltage application pulse duty.

Figure 17:
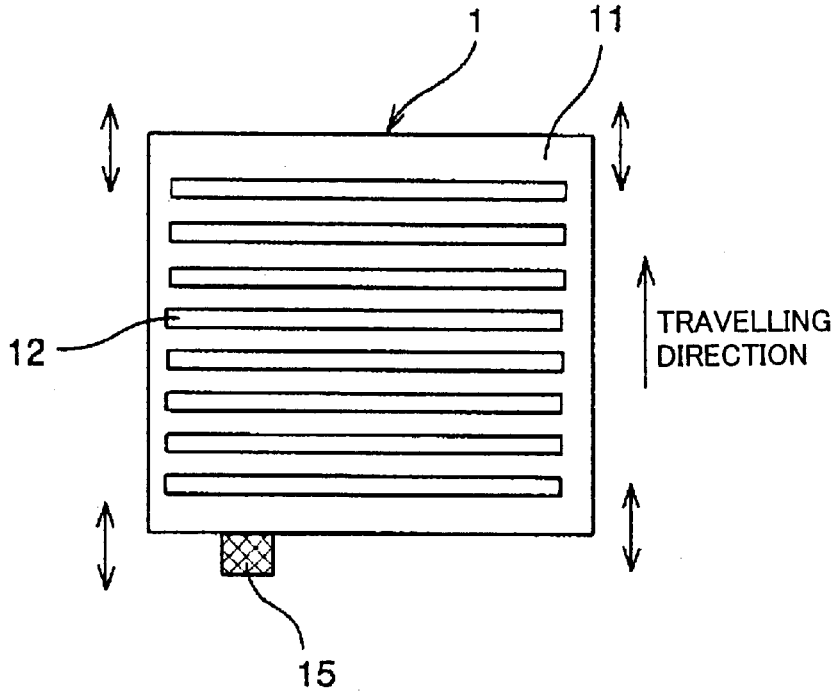
FIG. 17 is a diagram that shows one example of a second embodiment of an electrostatic transportation device according to the present invention.
Figure 18:
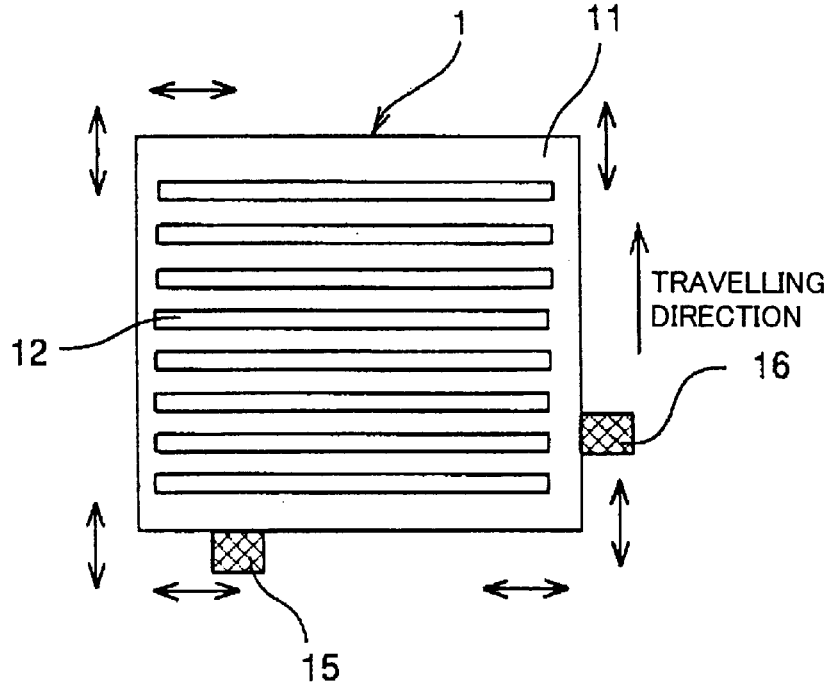
FIG. 18 is a diagram that shows another example of the second embodiment.

Next, a second embodiment of an electrostatic transportation device according to the present invention will be explained with reference to FIGS. 17 and 18. Incidentally, the respective figures are enlarged plan views which illustratively explaining a transporting base plate section of the electrostatic transportation device. This embodiment is provided with a vibration generating unit 15 which generates vibration imparting intermittent or continuous fine vibrations to the transporting base plate in a travelling direction of fine particles (the embodiment shown in FIG. 17) and another vibration generating unit 16 which generates vibration imparting intermittent or continuous fine vibrations to the transporting plate in a crossing direction to the travelling direction (the embodiment shown in FIG. 18).

As these vibration generating units 15 and 16, a PZT, a mechanical coil or the like can be used.

By finely vibrating the transporting base plate 1 intermittently or continuously in the travelling direction (longitudinal direction) of the toner particles by the vibration generating unit 15, a force due to the travelling wave field and vibrations are imparted to the toner particles to be transported. In the toner particles to be transported, there are variations in the magnitude of the charge amount, such as a large charge amount, a small charge amount, or presence of non-charged particles. Since toner particles with a small charge amount or non-charged toner particles are not suitable for electrostatic transportation, it is difficult to transport such toner particles, which results in an obstacle or a barrier wall for transportation. In some instances, therefore, some of toner particles are not transported, thereby causing stay of toner particles.

In view of the above, since spreading or dispersion of toner particles is performed by applying the intermittent vibrations or the continuous vibrations to toner particles, so that the transporting efficiency can be improved. Also, by applying the intermittent or continuous fine vibrations to the toner particles in the direction (transverse direction) crossing the travelling direction of the toner particles by the vibration generating unit 16, the spreading or dispersion of the toner particles can be performed more securely.

Here, it is preferable that the amplitude of the vibration in the longitudinal direction and the vibration in the transverse direction are set in a range of ⅕ to 2 times an average particle diameter of toner particles to be transported. The magnitude of the vibration amplitude depends on the speed of the toner transportation. However, when the magnitude exceeds 2 times the average particle diameter, the particle transportation and the travelling-wave field on the transporting base plate do not match with each other, which results in lowering of the transporting efficiency. Also, it is preferable that the vibration frequency is within a range of ⅕ to 3 times the driving frequency. When the vibration frequency exceeds 3 times the driving frequency, the particle transportation and the travelling-wave field of the transporting base plate do not match with each other, which causes lowering of the transporting efficiency.

Figure 19:
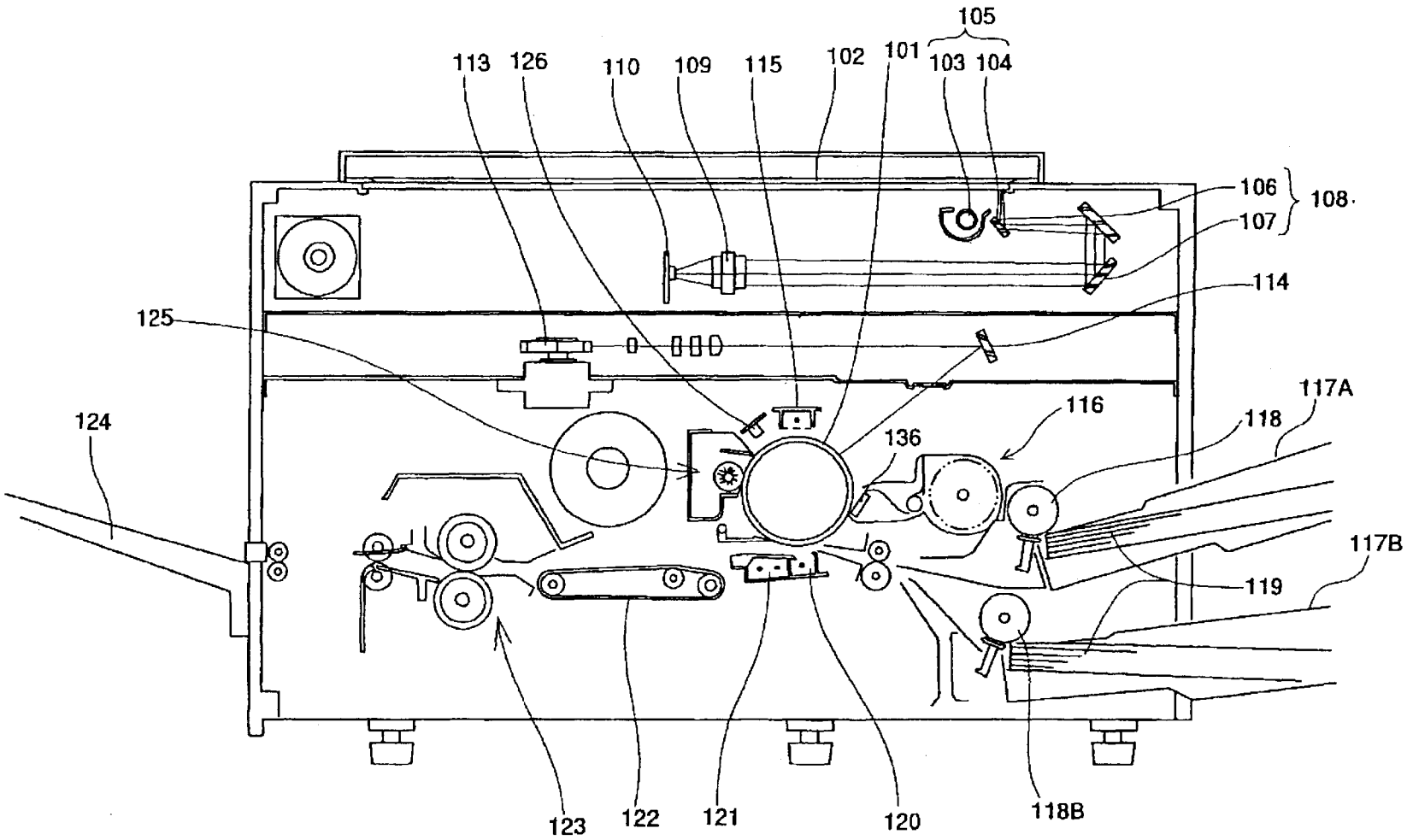
FIG. 19 is a diagram that shows a first embodiment of an image formation apparatus according to the present invention.

Next, a first embodiment of an image formation apparatus according to the present invention, provided with the development device according to the present invention including the electrostatic transportation device according to the present invention will be explained with reference to FIG. 19. The same figure is a diagram that schematically shows the entire configuration of the image formation apparatus. According to explanation of the entire outline and action of the image formation apparatus, a photosensitive drum 101 (for example, organic photosensitive body: OPC) which is an image carrier is rotationally driven in a clockwise direction in the same figure. When an original document is placed on a contact glass 102 and a print start switch (not shown) is turned on, a scanning optical system 105 including a document illuminating light source 103 and a mirror 104, and another scanning optical system 108 including mirrors 106 and 107 are moved so that reading of the original document is performed.

Here, the scanned original image is read in as an image signal by an image reading device 110 disposed behind a lens 109, the read image signal is digitized to be subjected to image processing. Then, a laser diode (LD) is driven by the image-processed signal, and after a laser beam from the laser diode is reflected by a polygon mirror 113, the reflected beam is irradiated onto the photosensitive drum 101 via a mirror 114. This photosensitive drum 101 has been uniformly charged in advance by a charging device 115, and an electrostatic latent image is formed on a surface of the photosensitive drum 101 by writing with the laser beam.

The electrostatic latent image on the surface of the photosensitive drum 101 is attached with toner particles to be visualized by a development device 116 according to the present invention, which is provided with the electrostatic transportation device according to the present invention, and the visualized image (toner image) is transferred to a transfer paper (recording medium) 119 by corona discharge of a transferring charger 120, the transfer paper being fed from a paper feeding section 117A or 117B by a paper feeding roll 118A or 118B. The transferring paper 119 on which the visualized image has been transferred is separated from the surface of the photosensitive drum 101 by a separating charger 121 to be transported by a transporting belt 122, and the visualized image is fused or fixed through a pressure-contacting section of a fusing roller pair 123 to be discharged to a discharged paper tray 124.

On the other hand, toner particles remaining on the surface of the photosensitive drum 101 whose transferring process has been terminated are removed by a cleaning device 125 and charge remaining on the surface of the photosensitive drum 101 is eliminated by a charge eliminating lamp 126.

Figure 20:
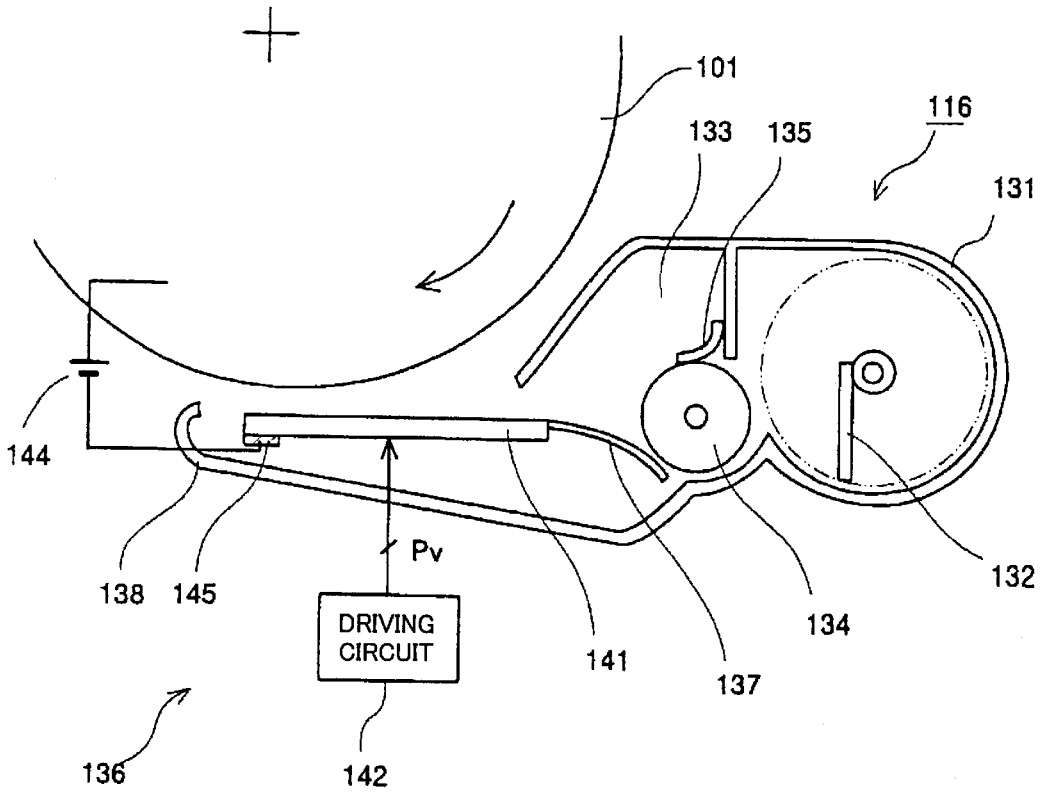
FIG. 20 is a diagram that shows a development device section of the image formation apparatus.

Next, the development device 116 according to the present invention, which is provided with the electrostatic transportation device according to the present invention in this image formation apparatus will be explained with reference to FIGS. 20 and 21. Incidentally, the same figure is a schematic configuration diagram of the development device.

The development device 116 is provided with a toner hopper section 131 which accommodates toner particles, an agitator 132 which agitates toner in the toner hopper section 131, a charging roller 134 which charges toner in the toner hopper section 131 to supply the same to a toner box 133, and a doctor blade 135 which is disposed in contact with a peripheral surface of the charging roller 134.

Also, the development device 116 is also provided with an electrostatic transportation device 136 according to the present invention comprising a toner supplying base plate 137 which is the transporting base plate of the electrostatic transportation device according to the present invention, for transporting toner supplied into the toner box section 133, and a transporting base plate 141 where a toner transporting section 141T which transports toner supplied from the toner supplying base plate 137 towards a developing section and a toner hopping section 141P constituting the developing section for performing hopping of toner transported by the toner transporting section 141T in the vicinity of the photosensitive drum 101 are continuously formed integrally with each other; and a toner recovery member 138 which recovers toner which has not been applied for development.

Furthermore, the development device 116 is provided with a driving circuit 142 which applies a driving waveform to a plurality of electrodes on the transporting base plate 141. Also, such a configuration may be employed that an electrode 145 which applies DC bias (100V to 200V) which is a developing bias voltage between the toner hopping section 141P of the transporting base plate 141 and the photosensitive drum 101 and a DC power source 144 is provided.

The toner transporting section 141T of the transporting base plate 141 is a section which transports toner towards the toner hopping section 141P which is the developing section, and it constitutes the electrostatic transportation device which transports fine particles towards the latent image carrier according to electrostatic force. Also, the toner hopping section 141P is a section which performs hopping of toner particles in the vicinity of the photosensitive drum 101 according to electrostatic force, and it constitutes the developing section and constitutes the electrostatic transporting section which performs hopping of fine particles in the vicinity of the latent image carrier.

Incidentally, as described above, toner on the transporting base plate 141 is subjected to transporting and hopping even in the toner transporting section 141T and even in the toner hopping section 141P. That is, the term "toner transporting section" means a section having an object of performing transporting of toner to the developing section, and the term "toner hopping section" means a section having an object of performing hopping of toner. Therefore, in these terms, there is not such a meaning that the hopping is not performed in the toner transporting section and the toner transporting is not performed in the toner hopping section.

As explained regarding the electrostatic transportation device according to the present invention, the transporting base plate 141 is constituted by providing a plurality of electrodes 12 which generate a travelling-wave field on the supporting base plate 11 and covering the surfaces of the electrodes 12 with the surface protective layer 13. Incidentally, each constituent element such as the width of each electrode 12 in the toner travelling direction (electrode width), the electrode pitch, the thickness of the electrode or the like, and each constituent element such as the thickness and the material of the surface protective layer 13 or the like are as described above.

Also, the toner supplying base plate 137 is constituted by using such a flexible base plate 161 such as a polyimide film as a base member which is a base and providing a plurality of electrodes 162 on the flexible base plate 161, it is for transporting toner towards the photosensitive drum 101, and it constitutes the electrostatic transportation device according to the present invention together with a driving circuit (not shown) (instead of this driving circuit, the first driving circuit 142 may be used) which applies driving waveforms of n phases to the electrodes 162.

Figure 21:
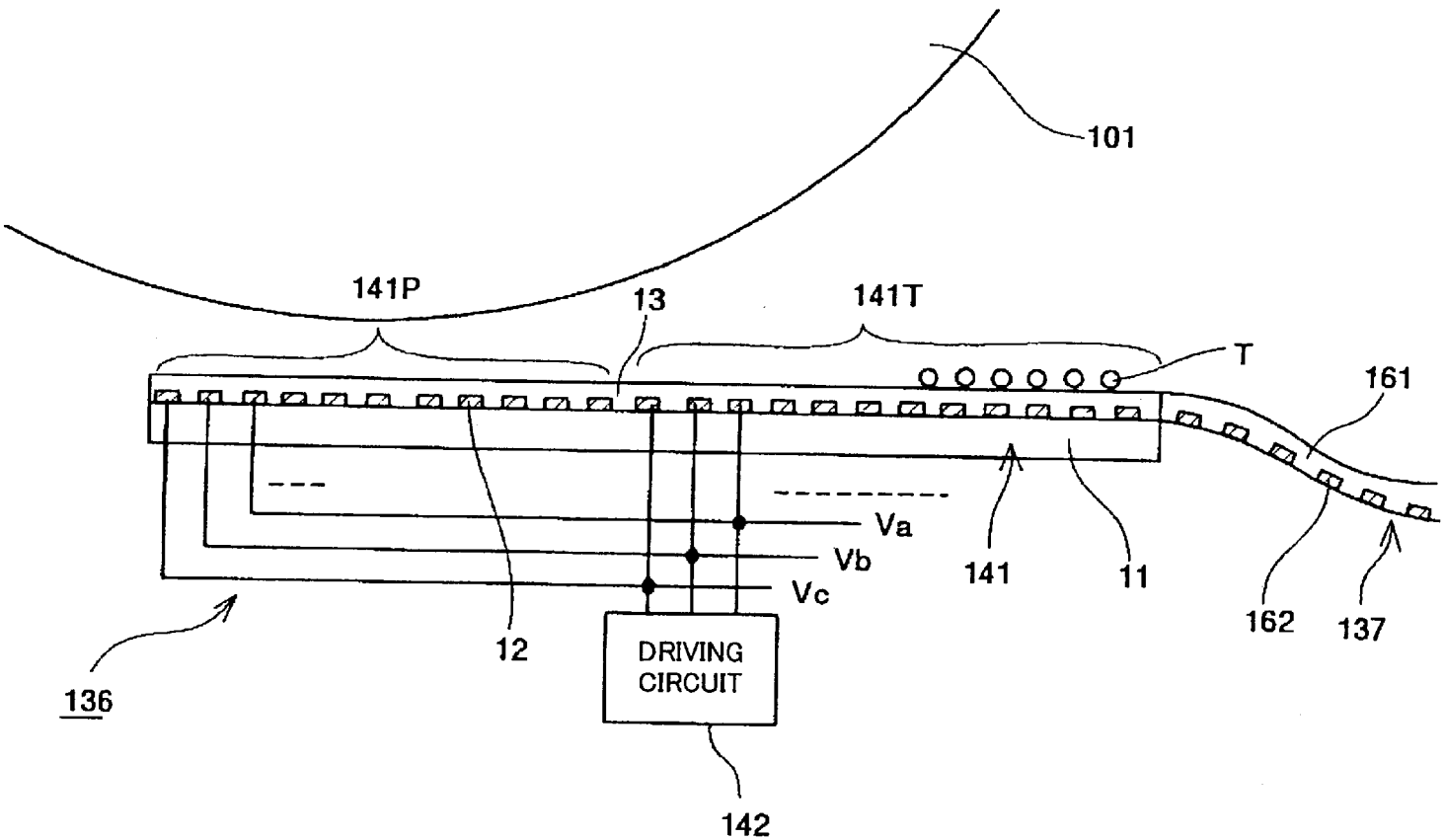
FIG. 21 is a diagram that shows a main section of the development device.

As shown in FIG. 21, the first driving circuit (driving power source) 142 defines three electrodes 12, 12 and 12 of the respective electrodes 12 of the toner transporting section 141T of the transporting base plate 141 which performs toner transportation as one set and applies pulse-like driving voltages (driving waveforms) Va, Vb and Vc of n phases (here, n=3, but n may be 4, 6 or the like) to respective electrodes 12.

A developing operation in the image formation apparatus thus configured will be explained. Charged toner particles in the toner box section 33 are transported by an electrostatic force by means of the toner supplying base plate 137 to reach the toner transporting section 141T. In the toner transporting section 141T, the toner particles are further transported by an electrostatic force towards the photosensitive drum 101 to be fed to the toner hopping section 141P.

Figure 22:
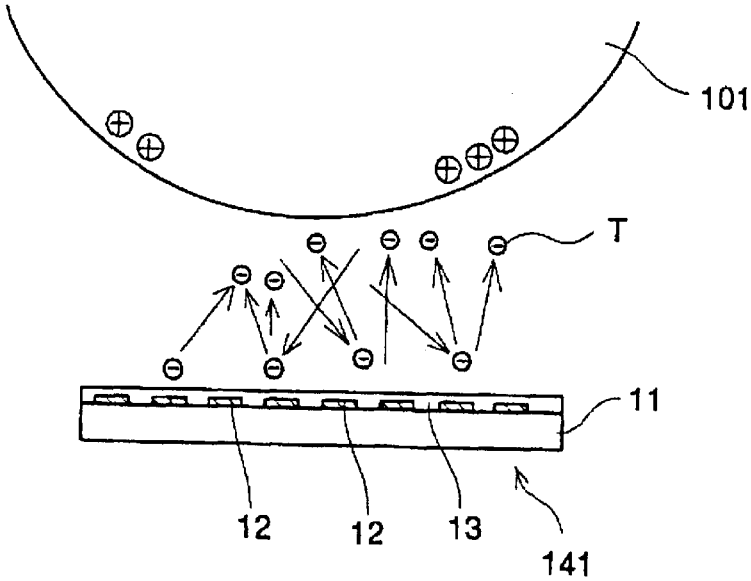
FIG. 22 is a diagram that shows a developing action of the development device.

In the toner hopping section 141P, toner particles T are hopping as shown in FIG. 22. Since the toner particles are hopping in the vicinity of the photosensitive drum 101, the following electric field may be generated in order to cause toner particles to attach to only the latent image section on the photosensitive drum 101. That is, an electric field obtained by an average value of the pulse-like driving voltage applied to the electrodes 12 of the hopping section 141P and a voltage of the latent image section formed on the photosensitive drum 101 is set to meet the relationship where toner particles are attracted towards the photosensitive drum 101 side, and an electric field obtained by an average value of the pulse-like driving voltage applied to the electrodes 12 of the toner hopping section 141P and a voltage of a non-latent image section formed on the photosensitive drum 101 is set to meet the relationship of the direction where toner particles are repelled from the photosensitive drum 101 side.

At this time, since an attracting force does not occur between toner particles which are now hopping and the transporting base plate 141, the toner particles can easily be transported to the image carrier (photosensitive drum 101), so that development capable of obtaining a high image quality can be performed at a low voltage.

That is, in the conventional jumping developing system, an application voltage equal to or more than an adhering force of toner particles to a developing roller is required in order to release charged toner particles from the developing roller to move them to the photosensitive member, which requires application of a bias voltage in a range of DC 600 to 900V. On the other hand, according to the present invention, the adhering force of toner particles is normally in a range of 50 to 200 nN, but the adhering force to the transporting base plate 141 becomes almost 0 because the toner particles are hopping on the transporting base plate 141. Therefore, a force for releasing toner particles from the transporting base plate 141 is not required, which allows sufficient transportation of the toner particles to the photosensitive body at a low voltage.

Toner particles which have been fed to the toner hopping section 141P but are not used are subjected to not only hopping but also transporting in the toner hopping section 141P so that they are discharged and recovered in the toner recovery member 38.

According to detailed explanation of this embodiment, by setting the electrode arrangement and configuration such as the width L of each electrode 12 of the toner hopping section 141P of the transporting base plate 141, the electrode pitch R or the like to the range explained in the embodiment of the electrostatic transportation device, a electrode arrangement and configuration where lines of electric force including a vertical component acting for hopping toner particles are generated above the electrodes 12 can be achieved, so that hopping of toner particles can be performed more efficiently, which results in improvement in developing efficiency.

Similarly, the restriction about the surface protective layer 13 of the toner hopping section 141P of the transporting base plate 141 is also set to the range explained in the embodiment of the electrostatic transportation device. That is, regarding the field intensity of a vertical component of the surface in the vicinity of the center of the electrode 12 at a position corresponding to the height of the toner diameter, the vertical component field which can apply a force acting for hopping to toner particles is in a range of (5E+5)V/m or more, a preferable electric field which does not cause the problem about attraction is in a range of (1E+6)V/m or more, and a more preferable electric field which can apply a further sufficient force to toner particles is in a range of (2E+6)V/m or more.

In this instance, regarding the electric field intensity acting for hopping, which is in the vicinity of the center of the electrode surface, as the thickness of the surface protective layer becomes thicker, the electric field in the direction of an adjacent electrode in the protective layer whose dielectric constant is higher than that of air lowers. Therefore, the practical range of the thickness of the protective layer about the efficiency lowering is 10 $\mu$m or less, and the range of the thickness which does not cause the problem about the attenuation of the vertical component electric field is 5$\mu$ or less. Thereby, a force serving for hopping can be applied to toner particles, and the field intensity of (1E+6)V/m or more, which does not cause the problem about the toner particle attraction can be obtained.

Also, regarding the relationship between the charge potential of the photosensitive drum 101 and the toner particles, when the toner particles are negative charged toner particles, the charge potential of the surface of the photosensitive drum 101 which is the image carrier is in a range of −300V or less, and when they are positive charged particles, the charge potential thereof is in a range of +300V or less. Namely, the charge potential of the surface of the image carrier is set to |300|V or less.

Therefore, in a state where electrodes are arranged with fine pitches, even when a voltage applied between the electrodes 12 and 12 is a low voltage of 150V to 100V or less, the electric field generated becomes very large, so that toner particles adhering on the surface of the electrode 12 can easily be released therefrom, which allows flying and hopping of the toner particles. Also, the amount of ozone or NO generated when a photosensitive body such as an OPC is charged can be reduced much largely or up to zero, which is of great advantage to environmental problems and the durability of the photosensitive body.

Accordingly, a high voltage bias of 500V to several KV is not required which has been applied between the developing roller and the photosensitive body in order to release toner particles which have attached to the developing roller surface or the carrier surface of the conventional system therefrom, so that it becomes possible to form a latent image and develop the same with a very low charge potential of the photosensitive body.

For example, when an OPC photosensitive body is used, the thickness of a CTL & KDUJH 7UDQVSRUM/D¥HU of the surface thereof is 15 $\mu$m, the dielectric constant $\in$ thereof is 3, and the electric charge density of a charged toner particle is (−3E−4C/m2, the surface potential of the OPC becomes about −170V. In this instance, when a pulse-like driving voltage with 0 to −100V and a duty cycle of 50% is applied as an application voltage to the electrodes on the transporting base plate, an average voltage becomes −50V, so that, when toner particles are negatively charged, an electric field between the electrodes of the transporting base plate and the OPC photosensitive body meets the relationship described above.

At this time, setting a gag (interval) between the transporting base plate and the OPC photosensitive body to 0.2 to 0.3 mm allows development sufficiently. The development voltage depends on an Q/M of toner particles, an application voltage to electrodes of a transporting base plate, a printing speed or a rotation speed of a photosensitive body. In instance of negatively charged toner particles, the development can be performed when the potential which charges the photosensitive body is −300V or less. Alternatively, in a configuration where the developing efficiency is preferential, the development can sufficiently be performed even when the potential is −100V or less. In an instance of positively charged toner particles, the charge potential becomes +potential.

Next, a spacing between the photosensitive body drum 101 which is the latent image carrier and the transporting base plate 141 will be explained. By setting the spacing between the a toner transporting surface and the latent image carrier within a range of 2 to 20 times a flying height of toner particles at a time of hopping, when an latent image electric field is present on the latent image carrier, toner particles on a region where a flying height is high further fly up to the latent image carrier to contribute to the development. On the other hand, toner particles on a region where the flying height is low can not fly up to the latent image carrier and they do not contribute to the development.

That is, FIG. 10 shows one example of the characteristics of the application voltage and the hopping height. When the application voltage is, for example, 100V constant, the Q/M of toner particles is changed to −10, −20, and −30 $\mu$C/g, the speed in a vertical direction is changed to Max 065, 1, and 125 m/sec, so that the flying height (hopping height) is changed to 100, 125, and 150 $\mu$m according to increase in Q/M.

Accordingly, when toner particles with a Q/M distribution is transported to the toner hopping section to be hopped, toner particles whose Q/M are small, for example, toner particles with 10 to 5 $\mu$C/g or less can not contribute to a development due to small flying heights thereof, so that the development is performed by toner particles with a predetermined Q/M or more.

Thereby, adhesion of toner particles to the latent image can securely be realized, scattering, moving or the like of toner particles after adhesion is prevented from occurring, thereby allowing development of a high image quality. Further, such a problem as a background dirt due to weakly charged toner particles or toner particles with a small level reverse polarity, which is problematic in the conventional development system can be avoided. That is, by applying the electrostatic transportation device according to the present invention to the development device to perform hopping, it is possible to utilize selectivity of Q/M about toner particles contributing to a development, and an image formation apparatus having a developing unit (development device) which performs development of a high image quality at a low voltage.

In view of the above, a spacing between the toner particle transporting face and the latent image carrier can be set within a range of ½ to 2 times the flying height of toner particles at a time of hopping.

In this instance, many particles of toner particles which have hopped collide on the surface of the latent image carrier at a predetermined velocity irrespective of a force due to the latent image electric field. As a result, since an attracting force of useless toner particles which have adhered to a latent image non-forming section is weak and an attracting force of toner particles of the outermost layer of toner particles which have adhered on a latent image section in a multiple layer is also weak, these toner particles with the weak attracting force are released and removed by toner particles colliding against the latent image carrier side at a required velocity, so that a larger scavenging effect can be obtained and an image with a higher sharpness can be obtained. Also, since more toner particles can be transported to the surface of the photosensitive body, even an image with a high density can be developed at a high speed.

Figure 23:
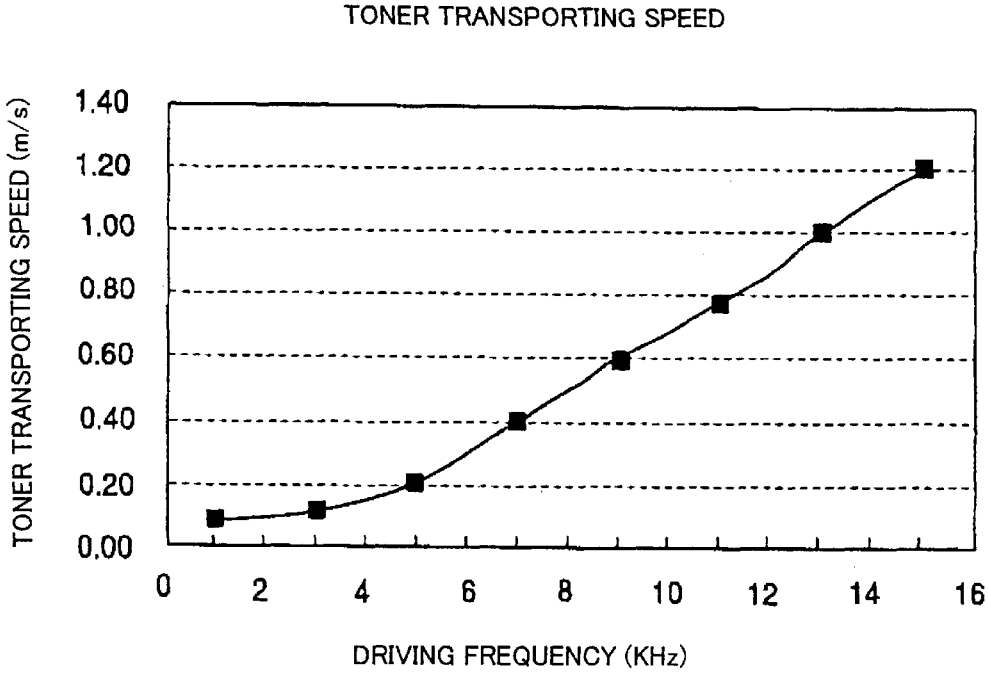
FIG. 23 is a graph that shows one example of a relationship between a driving frequency of a driving waveform and a toner transporting speed.

Next, the driving frequency of the driving waveform applied from the driving circuit 142 to the electrodes 12 of the transporting base plate 141 will be explained with reference to FIG. 23. FIG. 23 shows the result obtained by measuring a relationship of a transporting velocity to a driving frequency. Incidentally, a vertical line in the figure corresponds to the transporting velocity but it includes a hopping action in a vertical direction as an action.

As understood from the same figure, according increase in driving frequency, the transporting velocity increases. This is because the number of times of hopping of toner particles in the vicinity of an electrode due to switching of an electric field direction increases.

In view of the result obtained by actual measurement, by setting the driving frequency of the driving waveform within a range of 1 to 15 KHz, transporting and hopping actions can be performed normally. Therefore, by setting the driving frequency of the driving waveform according to a printing speed or an image density, an image with a high image quality can be formed.

That is, assuming that the image density is set to be constant, the amount of toner which is consumed for development is increased as the printing speed is increased. Assuming that the printing speed is set to be constant, the amount of toner which is consumed as the image density becomes high. When the amount of toner which is consumed increases, it is necessary to provide more toner to the toner hopping section (developing section). Therefore, by setting the driving frequency of the driving waveform corresponding to the printing speed or the image density, lack of the amount of toner to be supplied to the developing section can be prevented from occurring, so that an image with a high image quality can be obtained.

Figure 24:
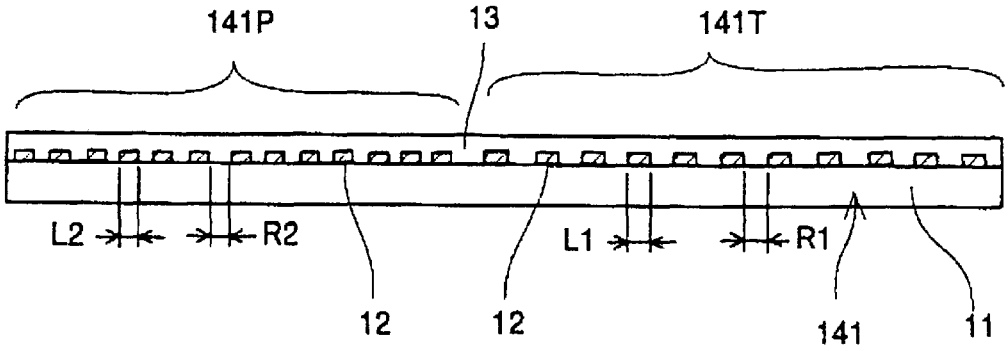
FIG. 24 is a diagram that shows a transporting base plate of a second embodiment of an image formation apparatus according to the present invention.

Next, a second embodiment of the image formation apparatus according to the present invention including the development device according to the present invention will be explained with reference to FIG. 24. This embodiment is structured such that an electrode width L1 of the electrode 12 provided on the toner transporting section 141T and an electrode pitch R1 thereon are respectively different from an electrode width L2 of each electrode 12 provided on the toner hopping section 141P and an electrode pitch R2 thereon.

That is, as described above, the electric field serving for hopping becomes stronger as both the electrode width L and the electrode pitch R are made narrower. Particularly, the electric field which can achieve a required velocity without the problem about the absorption is in a range of (1E+6)V/m or more, a preferable electric field which can provide a further sufficient force for hopping is in a range of (2E+6) V/m or more.

By making the width L2 of the electrode 12 of the toner hopping section 141P narrower than the width L1 of the electrode 12 of the toner transporting section 141T (L2<L1), toner hopping suitable for development can be obtained more efficiently. For example, the width L2 of the electrode 12 of the toner hopping section 141P is set to be 50 $\mu$m or less, more preferably 30 $\mu$m or less.

Similarly, by making the electrode pitch R2 of the toner hopping section 141P thinner than the electrode pitch R1 of the toner transporting section 141T (R2<R1), toner hopping suitable for development can be obtained more efficiently. For example, the electrode pitch R2 of the toner hopping section 141P is set to 50 $\mu$m or less, more preferably 30 $\mu$m or less.

Thereby, more secure hopping action with a high density can be obtained so that development with a high image quality can be performed.

Figure 25:
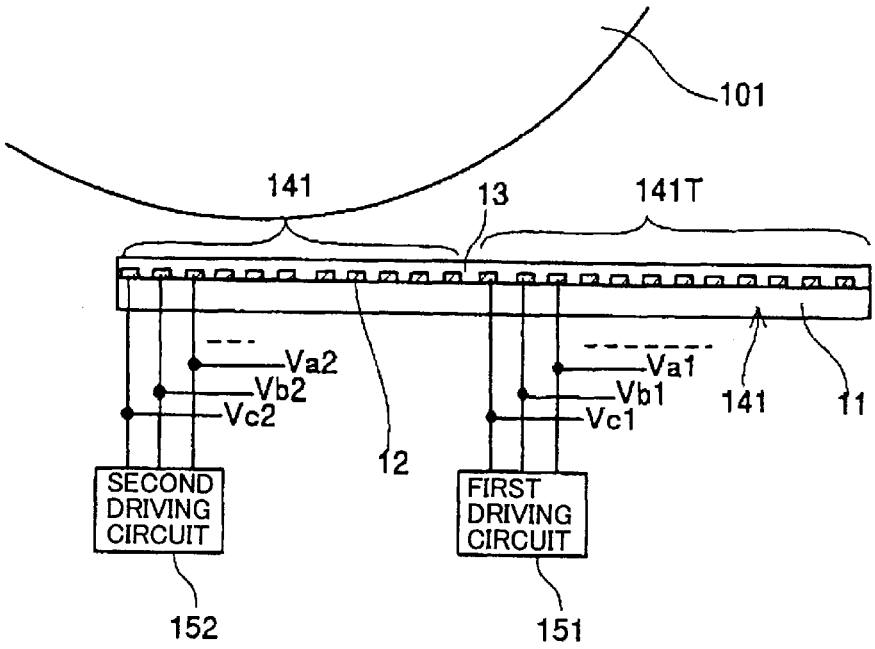
FIG. 25 is a diagram that shows a main section of a third embodiment of an image formation apparatus according to the present invention.

Next, a third embodiment of the image formation apparatus according to the present invention including the development device according to the present invention will be explained with reference to FIG. 25. This embodiment is provided with a first driving circuit 151 which applies driving waveforms of n phases to the electrodes 12 belonging to the toner transporting section 141T, of the plurality of electrodes 12 of the transporting base plate 141 and a second driving circuit 152 which applies driving waveforms of n phases to the electrodes 12 of the toner hopping section 141P.

The first driving circuit 151 applies pulse-like driving voltages (driving waveforms) Va1, Vb1 and Vc1 of a first driving frequency f1 of 1 KHz to 10 KHz to the respective electrodes 12, 12, 12, . . . of the toner transporting section 141T of the transporting base plate 141. Also, the second driving circuit 152 applies pulse-like driving voltages (driving waveforms) Va2, Vb2 and Vc2 of a second driving frequency f2 of 8 KHz to 15 KHz to the respective electrodes 12, 12, 12 . . . of the toner hopping section (developing section) 141P of the transporting base plate 141.

As described above, as the driving frequency of the driving waveform increases, the transporting speed (including the hopping action) increases. When a large amount of toner exceeding the amount of toner consumed in the toner hopping section 141P continues to be supplied to the developing section, a toner stay may occurs in the developing section depending on the area of the toner transporting section 141T. On the other hand, it is necessary to move useless toner which has not been used for development in the toner hopping section 141P to the toner recovery member side rapidly.

Therefore, such a configuration is employed that the driving frequency of the driving waveform in the toner transporting section 141T is made relatively low to prevent the amount of toner exceeding the amount of toner required from being supplied to the developing section, and the hopping speed is increased by making the driving frequency in the toner hopping section 141P relatively high to allow a rapid discharge of useless toner.

Thus, the transporting and hopping corresponding to the amount of toner fed into the developing section and the amount of toner consumed in the developing section, and an efficient hopping can be performed so that a development with a more stable image quality can be performed.

Figure 26:
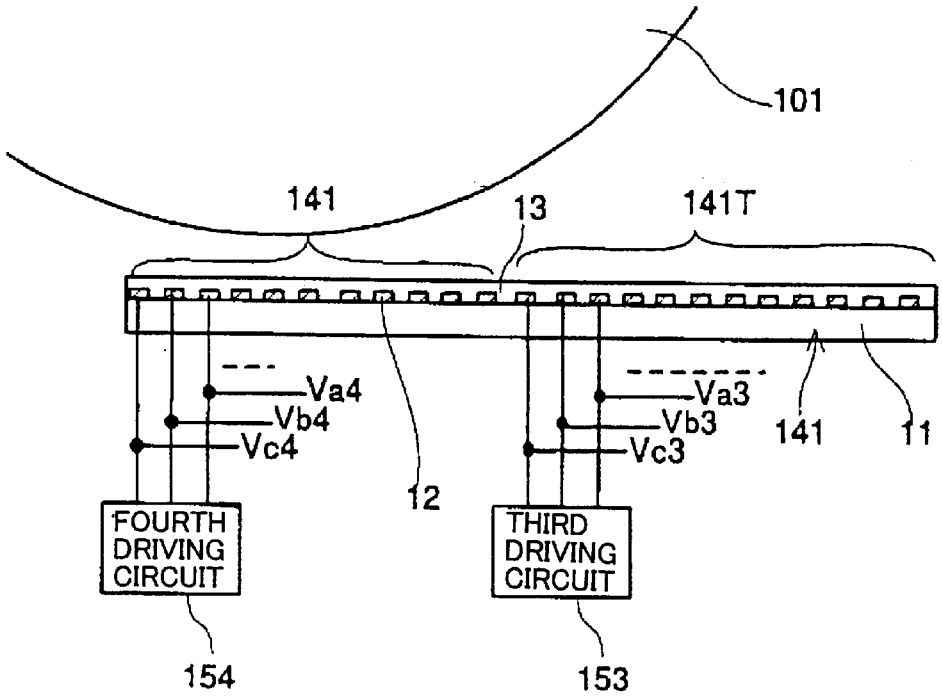
FIG. 26 is a diagram that shows a main section of a fourth embodiment of an image formation apparatus according to the present invention.

Next, a fourth embodiment of the image formation apparatus according to the present invention including the development device according to the present invention will be explained with reference to FIG. 26. This embodiment is provided with a third driving circuit 153 which applies driving waveforms of n phases to the electrodes 12 belonging to the toner transporting section 141T, of the plurality of electrodes 12 of the transporting base plate 141 and a fourth driving circuit 154 which applies driving waveforms of n phases to the electrodes 12 of the toner hopping section 141P.

The third driving circuit 153 applies three-phase pulse-like driving voltages (driving waveforms) Va3, Vb3 and Vc3 whose voltage application duty cycles are relatively large to the respective electrodes 12, 12, 12, . . . of the toner transporting section 141T of the transporting base plate 141. Also, the fourth driving circuit 154 applies pulse-like driving voltages of three phases (driving waveforms) whose voltage application duty cycles are low to the respective electrodes 12, 12, 12 . . . of the toner hopping section (developing section) 141P of the transporting base plate 141. That is, for example, the fourth driving circuit 144 outputs the driving waveform whose voltage application duty cycle is 33% shown in FIG. 16, while the third driving circuit 143 outputs the driving waveform whose voltage application duty cycle is about 67%.

That is, as described above, as the voltage application duty cycle of the driving waveforms of n phases becomes smaller, a degree of a repelling force and an attracting force acting between the observed electrode and both electrodes adjacent thereto becomes larger and the transporting speed is increased.

Accordingly, like the third embodiment, the transporting and hopping corresponding to the amount of toner fed into the developing section and the amount of toner consumed in the developing section can be performed so that a development with a more stable image quality can be performed.

Figure 27:
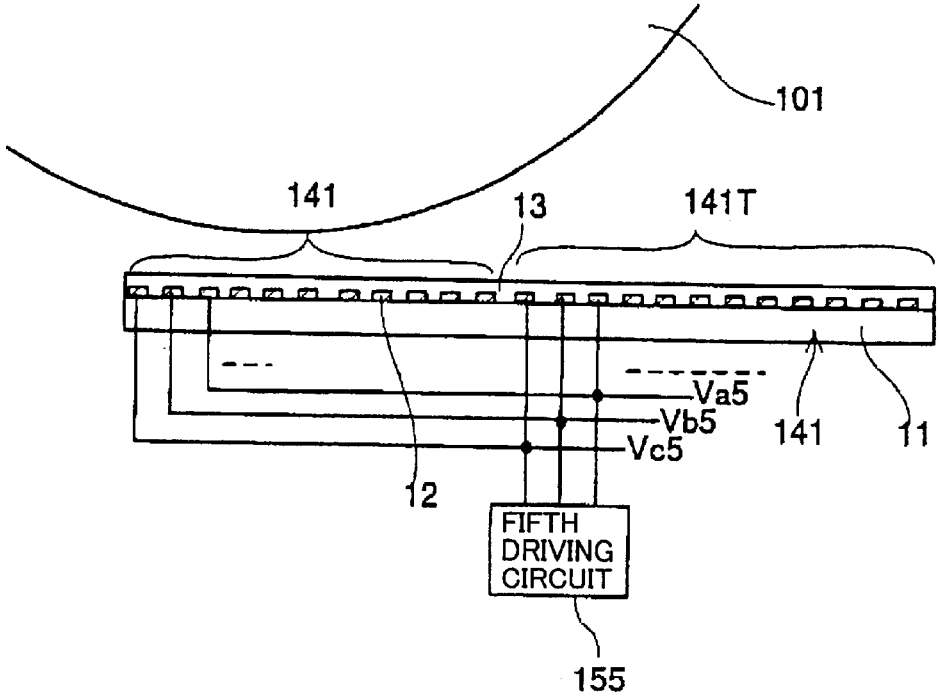
FIG. 27 is diagrams that show a main section of a fifth embodiment of an image formation apparatus according to the present invention.
Figure 28:
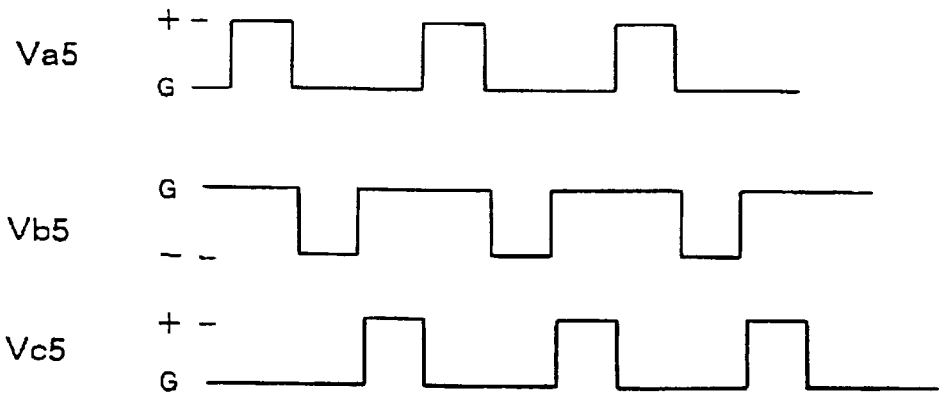
FIG. 28 is a diagram that shows driving waveforms output from a fifth driving circuit of the image formation apparatus.

Next, a fifth embodiment of the image formation apparatus according to the present invention including the development device according to the present invention will be explained with reference to FIG. 27. This embodiment is provided with a fifth driving circuit 155 which applies driving waveforms of n phases to the plurality of electrodes 12 of the transporting base plate 141, and the fifth driving circuit 155 outputs waveforms at least one phase of which is different in polarity from the other phases, as shown in FIG. 28.

Thus, when the driving waveforms of three phases are different in polarity (positive, negative polarity and zero voltage), a potential difference between the adjacent electrodes becomes high, so that the hopping can be performed securely.

Figure 29:
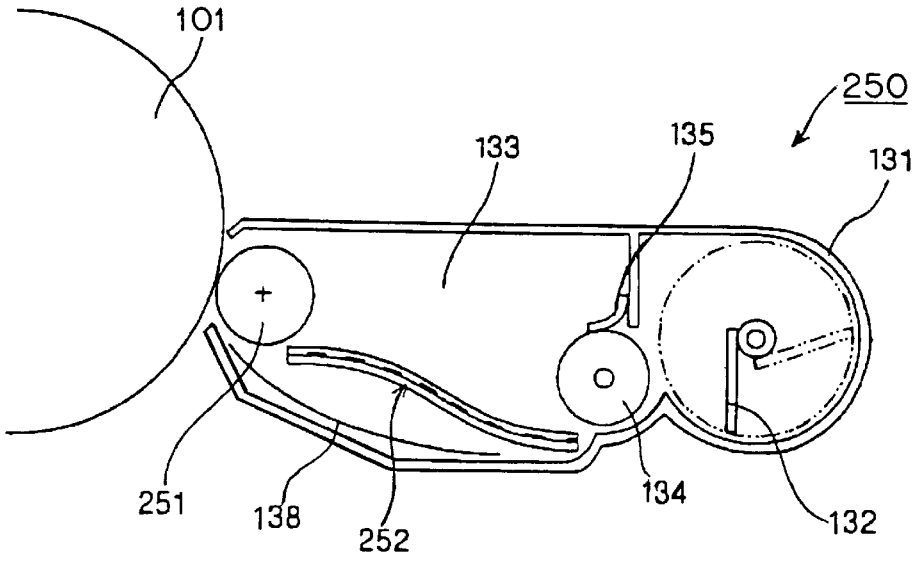
FIG. 29 is a diagram that shows a main section of a sixth embodiment of an image formation apparatus according to the present invention.

Next, a sixth embodiment of the image formation apparatus according to the present invention including the development device according to the present invention will be explained with reference to FIG. 29. This embodiment is configured such that a latent image on the photosensitive drum 101 is developed using a developing roller 251 constituting a developing section and it is provided with a development device 250 which transports and supplies toner to the developing roller 251 by an electrostatic force using a toner supplying base plate 252 having a constitution similar to the transporting base plate explained regarding each electrostatic transportation device described above.

By supplying toner to the developing roller 251 using the toner supplying base plate 252 in this manner, configuration of a toner supplying system to the developing roller 251 can be simplified. Even when the developing roller is used in the developing section, small sizing of the development device or the image formation apparatus can be achieved.

Incidentally, in the embodiments of the present invention, examples where the electrostatic transportation device according to the present invention has been applied to the development device and the image formation apparatus have been explained. However, for example, since the magnitude of hopping of toner particles depends on Q/m (charge and mass) of toner particles, the electrostatic transportation device according to the present invention is applicable to a toner classifying device which selects only toner particles with Q/m in a predetermined range, and it is also applicable to a classifying device which classifies (selects) fine particles other than toner particles. Also, in the embodiments, the photosensitive drum is used as the photosensitive body of the image formation apparatus, but a belt-like photosensitive body may be used in this invention. Also, such a configuration can be employed that an image is once transferred to an intermediate transferring member instead of direct transferring of an image on a transferring paper.

As explained above, according to the electrostatic transportation device according to the present invention, since an electrode width of each electrode and an electrode pitch of a plurality of electrodes which generate an electric field for performing transporting and hopping of fine particles by an electrostatic force are respectively set to predetermined ranges, fine particles are prevented from staying so that the fine powders can be moved stably and efficiently.

Here, by forming an inorganic or organic surface protective layer with a predetermined thickness which covers electrodes on the transporting base plate, an electric field of a vertical component can be made strong so that the transporting and hopping efficiencies can be improved.

Also, since the transporting base plate is structured by forming thin layer electrodes and a thin layer protective layer on a base member which serves as a base sequentially in a stacking manner by an etching process, a deposition process or a combination of the etching process and the deposition process, fine pitch thin layer electrodes with a large width size can be manufactured with an excellent yield. In addition, an electrostatic force sufficient for transporting and hopping of fine particles can be obtained at a low voltage so that the fine particles can be moved stably and efficiently.

Also, since the thickness of the electrode is set so as not to exceed 3 $\mu$m, it becomes unnecessary to perform a flattening process on the transporting base plate surface even when the surface protective layer is provided.

Further, since the base member which serves as the base of the transporting base plate is formed from flexibly deformable material, the degree of freedom when the transporting base plate is used can be improved.

Also, since at least outermost layer of the surface protective layer provided on the transporting base plate is formed from a material positioned in the vicinity of a material used as a charge controlling agent of fine particles on a frictional charge sequence or a material positioned at an end side of a polarity opposed to the charged polarity of fine particles, variations of the charged polarity and the charge amount of fine particles can be suppressed so that the hopping efficiency can be prevented from lowering.

Furthermore, since the outermost surface of the surface protective layer provided on the transporting base plate is coarsened, the contacting area of the outermost surface with fine particles is reduced and the fine particles are prevented from staying efficiently so that the transporting and hopping efficiencies can be improved.

Also, since pulse-like driving waveforms of n phases or more (n is an integer of 3 or more) is applied and a voltage application time corresponding to one phase is set to be less than [cycle period time×(n−1)/N], the transporting and hopping efficiencies can be improved. Further, since pulse-like driving waveforms of n phases or more (n is an integer of 3 or more) is applied, and a time period when a voltage which repels fine particles is applied to an electrode of a observed phase and a time period when a voltage which repels fine particles is applied to an upstream side electrode adjacent thereto and simultaneously a voltage which attracts fine particles is applied to a downstream side electrode adjacent thereto are set to 30 μm or more, the transporting and hopping efficiencies can be improved.

Furthermore, since the unit which vibrates the transporting base plate intermittently or continuously is provided, fine particles with a low charge amount can be prevented from staying, so that stable and efficient transporting and hopping can be performed.

According to the image formation apparatus according to the present invention, since the electrostatic transportation device according to the present invention, which has the transporting base plate which transports fine particles towards the developing section by an electrostatic force is provided, an efficient toner supplying to the developing section can be performed, so that small-sizing of the entire apparatus can be achieved. Also, according to the image formation apparatus according to the present invention, since the electrostatic transportation device according to the present invention, which has the transporting base plate which performs hopping of fine particles in the latent image carrier by an electrostatic force, an image formation with a high image quality can be performed at a low voltage driving. Further, since the image formation apparatus according to the present invention is provided with both of the electrostatic transportation device, small sizing of the apparatus and improvement of an image quality can be achieved.

In an instance that both of the transporting base plate which transports fine particles towards the development device by an electrostatic force and the transporting base plate which performs hopping of fine particles in the vicinity of the latent image carrier by an electrostatic force are provided, a configuration can be simplified by forming the two transporting base plates integrally or forming the two individual transporting base plates continuously.

Also, since the width and/or the electrode pitch, in the travelling direction of fine particles, of the electrodes of the transporting base plate which performs hopping of fine particles in the vicinity of the latent image carrier is narrower than the width and/or the electrode pitch, in the travelling direction of fine particles, of electrodes of the transporting base plate which transports fine particles towards the development device by an electrostatic force, the amount of supply of fine particles and the amount of consumption thereof can be balanced with each other, so that more stable development can be performed.

In each image formation apparatus according to the present invention, since the transporting base plate which performs hopping of fine particles by an electrostatic force is provided with a plurality of electrodes which generates lines of electric force of a vertical component serving as hopping action above the electrodes, the developing efficiency can be improved.

Also, since a vertical field intensity at a height position corresponding to the diameter of each fine particle on the surface in the vicinity of the electrode center of the surface of the transporting base plate which performs hopping of fine particles by an electrostatic force is 1×106V/m or more, the developing efficiency can be improved.

Further, since the charge potential of the latent image carrier surface is |300|V or less, a development at a low potential is made possible, generation of ozone at a time of charge can be reduced and the durability of the latent image carrier can be improved.

Furthermore, since the spacing between the latent image carrier and the surface of the transporting base plate which performs hopping of fine particles by an electrostatic force is in a range of 2 to 10 times the flying height of fine particles at a time of hopping, an image with a high image quality can be obtained at a low voltage. Alternatively, since the spacing between the latent image carrier and the surface of the transporting base plate which performs hopping of fine particles by an electrostatic force is in a range of ½ to 2 times the flying height of fine particles at a time of hopping, the scavenger effect can be increased and a high density image can be developed at a high speed.

Also, since driving waveforms where a driving frequency of each phase is in a range of 1 KHz to 15 KHz are applied to the electrodes of the transporting base plate which performs hopping of fine particles by an electrostatic force, the transporting and hopping efficiencies can be improved and the developing efficiency can be improved. Further, since driving wave forms where at least one phase is different in polarity from another phase are applied to the electrodes of the transporting base plate which performs hopping of fine particles by an electrostatic force, the transporting and hopping efficiencies can be improved and the developing efficiency can be improved.

Further, since the driving waveform which is applied to the electrodes of the transporting base plate which transports fine particles and the driving wave form which is applied to the electrodes of the transporting base plate which performs hopping of fine particles are different in frequency or voltage application duty cycle, the supply amount of fine particles and the consumption amount thereof can be well balanced with each other, and a more stable development can be performed.

According to the development device according to the present invention, since the electrostatic transportation device according to the present invention, which has the transporting base plate which transports fine particles towards the developing section by an electrostatic force is provided, an efficient toner supply to the developing section can be performed and the small-sizing of the development device can be achieved. Also, according to the development device according to the present invention, since the electrostatic transportation device according to the present invention, which has the transporting base plate which performs hopping of fine particles in the vicinity of the latent image carrier by an electrostatic force is provided, a development with a high image quality can be performed at a low voltage driving. Furthermore, according to the image formation apparatus according to the present invention, since the image formation apparatus according to the present invention is provided with the electrostatic transportation device having both the transporting base plates, small-sizing of the apparatus and improvement of an image quality can be achieved.

The present document incorporates by reference the entire contents of Japanese priority documents, 2001-073565 filed in Japan on Mar. 15, 2001 and 2002-034814 filed in Japan on Feb. 13, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An electrostatic transportation device which moves fine particles by an electrostatic force, comprising:

a transporting base plate which has a plurality of electrodes which generate an electric field which performs transporting and hopping of fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, driving waveforms of n phases or more (n is an integer of 3 or more) are applied to respective electrodes, the transporting base plate has an inorganic or organic surface protective layer covering the electrodes, and the thickness of the surface protective layer does not exceed 10 $\mu$m; the surface protective layer comprises a single layer or a plurality of layers, at least the outermost layer of the surface protective layer provided on the transporting base plate is formed from a material positioned in the vicinity of a material used as a charge controlling agent of fine particles on a frictional charge sequence or a material positioned on a positive end side, and fine particles with a negatively charged polarity is are moved.

2. The electrostatic transportation device according to claim 1, wherein the thickness of the electrodes does not exceed 3 $\mu$m.

3. An electrostatic transportation device which moves fine particles by an electrostatic force, comprising:

a transporting base plate which has a plurality of electrodes which generate an electric field which performs transporting and hopping of fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, driving waveforms of n phases or more (n is an integer of 3 or more) are applied to respective electrodes, the transporting base plate has an inorganic or organic surface protective layer covering the electrodes, and the thickness of the surface protective layer does not exceed 10 $\mu$m; the surface protective layer comprises a single layer or a plurality of layers, at least the outermost layer of the surface protective layer provided on the transporting base plate is formed from a material positioned in the vicinity of a material used as a charge controlling agent of fine particles on a frictional charge sequence or a material positioned on a negative end side, and fine particles with a positively charged polarity are moved.

4. The electrostatic transportation device according to claim 3, wherein the thickness of the electrodes does not exceed 3 $\mu$m.

5. An electrostatic transportation device which moves fine particles by an electrostatic force, comprising:

a transporting base plate which has a plurality of electrodes which generate an electric field which performs transporting and hopping of fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, driving waveforms of n phases or more (n is an integer of 3 or more) are applied to respective electrodes, the transporting base plate has an inorganic or organic surface protective layer covering the electrodes, and the thickness of the surface protective layer does not exceed 10 $\mu$m; and the outermost surface of the surface protective layer is coarsened.

6. The electrostatic transportation device according to claim 5, wherein the thickness of the electrodes does not exceed 3 $\mu$m.

7. An electrostatic transportation device which moves fine particles by an electrostatic force, comprising:

a transporting base plate which has a plurality of electrodes which generate an electric field which performs transporting and hopping of fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, driving waveforms of n phases or more (n is an integer of 3 or more) are applied to respective electrodes, and pulse-like driving waveforms of n phases (n is an integer of 3 or more) or more are applied and a voltage application time per one phase is less than cycle period time $x(n-1)/n$).

8. The electrostatic transportation device according to claim 7, wherein the transporting base plate is constituted by forming thin layer electrodes and a thin layer surface protective layer on a base member serving as a base sequentially in a stacking manner by an etching process, a deposition process or a combination of the etching process and the deposition process.

9. The electrostatic transportation device according to claim 8, wherein the thin layer electrodes are formed by etching or patterning after formed by a vapor deposition process or an electro-deposition process, and the protective layer is formed by a sputtering, coating, or spray coating.

10. The electrostatic transportation device according to claim 7, wherein a base member serving as the transporting base plate is formed from a flexibly deformable material.

11. The electrostatic transportation device according to claim 7, further comprising a unit which vibrates the transporting base plate intermittently or continuously.

12. An electrostatic transportation device which moves fine particles by an electrostatic force, comprising:

a transporting base plate which has a plurality of electrodes which generate an electric field which performs transporting and hopping of fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, driving waveforms of n phases or more (n is an integer of 3 or more) are applied to respective electrodes, pulse-like driving waveforms of n phases (n is an integer of 3 or more) or more are applied, and a time period when a voltage which repels fine particles is applied to an electrode of a observed phase and a time period when a voltage which repels fine particles is applied to an upstream side electrode adjacent thereto and simultaneously a voltage which attracts fine particles is applied to a downstream side electrode adjacent thereto are set to 30 μsec or more.

13. The electrostatic transportation device according to claim 12, wherein the transporting base plate is constituted by forming thin layer electrodes and a thin layer surface protective layer on a base member serving as a base sequentially in a stacking manner by an etching process, a deposition process or a combination of the etching process and the deposition process.

14. The electrostatic transportation device according to claim 13, wherein the thin layer electrodes are formed by etching or patterning after formed by a vapor deposition process or an electro-deposition process, and the protective layer is formed by a sputtering, coating, or spray coating.

15. The electrostatic transportation device according to claim 12, wherein a base member serving as the transporting base plate is formed from a flexibly deformable material.

16. The electrostatic transportation device according to claim 12, further comprising a unit which vibrates the transporting base plate intermittently or continuously.

17. An image formation apparatus which causes fine particles to adhere to a latent image carrier to develop a latent image on the latent image carrier, comprising:

an electrostatic transportation device which moves fine particles by an electrostatic force, and which has a transporting base plate which performs hopping of the fine particles in the vicinity of the latent image carrier by an electrostatic force, the transporting base plate having a plurality of electrodes which generates an electric field which performs transporting and hopping of the fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, and driving waveforms of n phases or more (n is an integer of 3 or more) are applied to respective electrodes:

wherein a vertical field intensity at a height position corresponding to the average diameter of each fine particle on the surface in the vicinity of the electrode center of the surface of the transporting base plate which performs hopping of the fine particles by an electrostatic force is $1\times10^6$ V/m or more.

18. The image formation apparatus according to claim 17, wherein the transporting base plate which performs hopping of the fine particles by an electrostatic force has a plurality of electrodes which generate lines of electric force of a vertical component which serve as a hopping action above the electrodes.

19. The image formation apparatus according to claim 17, wherein the charge potential of the surface of the latent image carrier surface is |300| V or less.

20. The image formation apparatus according to claim 17, wherein driving waveforms where a driving frequency of each phase is in a range of 1 KHz to 15 KHz are applied to the electrodes of the transporting base plate which performs hopping of the fine particles by an electrostatic force.

21. An image formation apparatus which causes fine particles to adhere to a latent image carrier to develop a latent image on the latent image carrier, comprising:

an electrostatic transportation device which moves fine particles by an electrostatic force, and which has a transporting base plate which performs hopping of the fine particles in the vicinity of the latent image carrier by an electrostatic force, the transporting base plate having a plurality of electrodes which generates an electric field which performs transporting and hopping of the fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, and driving waveforms of n phases or more (n is an integer of 3 or more) are applied to respective electrodes;

wherein a spacing between the latent image carrier and the surface of the transporting base plate which performs hopping of the fine particles by an electrostatic force is in a range of 2 to 10 times a hopping height of the fine particles.

22. The image formation apparatus according to claim 21, wherein the transporting base plate which performs hopping of the fine particles by an electrostatic force has a plurality of electrodes which generate lines of electric force of a vertical component which serve as a hopping action above the electrodes.

23. The image formation apparatus according to claim 21, wherein the charge potential of the surface of the latent image carrier surface is |300| V or less.

24. The image formation apparatus according to claim 21, wherein driving waveforms where a driving frequency of each phase is in a range of 1 KHz to 15 KHz are applied to the electrodes of the transporting base plate which performs hopping of the fine particles by an electrostatic force.

25. An image formation apparatus which causes fine particles to adhere to a latent image carrier to develop a latent image on the latent image carrier, comprising:

an electrostatic transportation device which moves fine particles by an electrostatic force, and which has a transporting base plate which performs hopping of the fine particles in the vicinity of the latent image carrier by an electrostatic force, the transporting base plate having a plurality of electrodes which generates an electric field which performs transporting and hopping of the fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, and driving waveforms of n phases or more (n is an integer of 3 or more) are applied to respective electrodes;

wherein a spacing between the latent image carrier and the surface of the transporting base plate which performs hopping of the fine particles by an electrostatic force is in a range of ½ to 2 times a hopping height of the fine particles.

26. The image formation apparatus according to claim 25, wherein the transporting base plate which performs hopping of the fine particles by an electrostatic force has a plurality of electrodes which generate lines of electric force of a vertical component which serve as a hopping action above the electrodes.

27. The image formation apparatus according to claim 25, wherein the charge potential of the surface of the latent image carrier surface is |300| V or less.

28. The image formation apparatus according to claim 25, wherein driving waveforms where a driving frequency of each phase is in a range of 1 KHz to 15 KHz are applied to the electrodes of the transporting base plate which performs hopping of the fine particles by an electrostatic force.

29. An image formation apparatus which causes fine particles to adhere to a latent image carrier to develop a latent image on the latent image carrier, comprising:

an electrostatic transportation device which moves fine particles by an electrostatic force, and which has a transporting base plate which performs hopping of the fine particles in the vicinity of the latent image carrier by an electrostatic force, the transporting base plate having a plurality of electrodes which generates an electric field which performs transporting and hopping of the fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, and driving waveforms of n phases or more (n is an integer of 3 or more) are applied to respective electrodes;

wherein driving waveforms where at least one phase is different in polarity from another phase are applied to the electrodes of the transporting base plate which performs hopping of the fine particles by an electrostatic force.

30. The image formation apparatus according to claim 29, wherein the transporting base plate which performs hopping of the fine particles by an electrostatic force has a plurality of electrodes which generate lines of electric force of a vertical component which serve as a hopping action above the electrodes.

31. The image formation apparatus according to claim 29, wherein the charge potential of the surface of the latent image carrier surface is |300| V or less.

32. The image formation apparatus according to claim 29, wherein driving waveforms where a driving frequency of each phase is in a range of 1 KHz to 15 KHz are applied to the electrodes of the transporting base plate which performs hopping of the fine particles by an electrostatic force.

33. An image formation apparatus which causes fine particles to adhere to a latent image carrier to develop a latent image on the latent image carrier, comprising:

an electrostatic transportation device which moves fine particles by an electrostatic force, and which has a transporting base plate which performs hopping of the fine particles in the vicinity of the latent image carrier by an electrostatic force, the transporting base plate having a plurality of electrodes which generates an electric field which performs transporting and hopping of the fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, and driving waveforms of n phases or more (n is an integer of 3 or more) are applied to respective electrodes;

wherein a driving waveform which is applied to the electrodes of the transporting base plate which transports the fine particles by an electrostatic force and a driving waveform which is applied to the electrodes of the transporting base plate which performs hopping of the fine particles are different in frequency and/or voltage application duty cycle.

34. The image formation apparatus according to claim 33, wherein the transporting base plate which performs hopping of the fine particles by an electrostatic force has a plurality of electrodes which generate lines of electric force of a vertical component which serve as a hopping action above the electrodes.

35. The image formation apparatus according to claim 33, wherein the charge potential of the surface of the latent image carrier surface is |300| V or less.

36. The image formation apparatus according to claim 33, wherein driving waveforms where a driving frequency of each phase is in a range of 1 KHz to 15 KHz are applied to the electrodes of the transporting base plate which performs hopping of the fine particles by an electrostatic force.

37. An image formation apparatus which causes fine particles to adhere to a latent image carrier to develop a latent image on the latent image carrier, comprising:

an electrostatic transportation device which moves fine particles by an electrostatic force and which has a transporting base plate which transports the fine particles towards a developing section side by an electrostatic force, the transporting base plate having a plurality of electrodes which generates an electric field which performs transporting and hopping of the fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, and driving waveforms of n phases or more (n is an integer of 3 or more) are applied to respective electrodes; and an electrostatic transportation device which moves fine particles by an electrostatic force, and which has a transporting base plate which performs hopping of the transporting fine particles in the vicinity of the latent image carrier by an electrostatic force, the transporting base plate having a plurality of electrodes which generates an electric field which performs transporting and hopping of the fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, and driving waveforms of n phases or more (n is an integer of 3 or more) are applied to respective electrodes;

wherein a width and/or an electrode pitch, in the travelling direction of the fine particles, of the electrodes of the transporting base plate which perform hopping of the fine particles in the vicinity of the latent image carrier by an electrostatic force is narrower than a width and/or an electrode pitch, in the travelling direction of fine particles, of the electrodes of the transporting base plate which transport the fine particles towards the developing section by an electrostatic force.

38. The image formation apparatus according to claim 37, wherein a transporting base plate which transports the fine particles towards the developing section side by an electrostatic force and a transporting base plate which performs hopping of the fine particles in the vicinity of the latent image carrier by an electrostatic force are formed integrally with each other or formed continuously by individual members.

39. The image formation apparatus according to claim 37, wherein the transporting base plate which performs hopping of the fine particles by an electrostatic force has a plurality of electrodes which generate lines of electric force of a vertical component which serve as a hopping action above the electrodes.

40. The image formation apparatus according to claim 37, wherein the charge potential of the surface of the latent image carrier surface is |300| V or less.

41. The image formation apparatus according to claim 37, wherein driving waveforms where a driving frequency of each phase is in a range of 1 KHz to 15 KHz are applied to the electrodes of the transporting base plate which performs hopping of the fine particles by an electrostatic force.

42. An image formation apparatus which causes fine particles to adhere to a latent image carrier to develop a latent image on the latent image carrier, comprising:

an electrostatic transportation device which moves fine particles by an electrostatic force and which has a transporting base plate which transports the fine particles towards a developing section side by an electrostatic force, the transporting base plate having a plurality of electrodes which generates an electric field which performs transporting and hopping of the fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, and driving waveforms of n phases or more (n is an integer of 3 or more) are applied to respective electrodes; and an electrostatic transportation device which moves fine particles by an electrostatic force, and which has a transporting base plate which performs hopping of the transporting fine particles in the vicinity of the latent image carrier by an electrostatic force, the transporting base plate having a plurality of electrodes which generates an electric field which performs transporting and hopping of the fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, and driving waveforms of n phases or more (n is an integer of 3 or more) are applied to respective electrodes;

wherein a vertical field intensity at a height position corresponding to the average diameter of each fine particle on the surface in the vicinity of the electrode center of the surface of the transporting base plate which performs hopping of the fine particles by an electrostatic force is $1\times10^6$ V/m or more.

43. The image formation apparatus according to claim 42, wherein a transporting base plate which transports the fine particles towards the developing section side by an electrostatic force and a transporting base plate which performs hopping of the fine particles in the vicinity of the latent image carrier by an electrostatic force are formed integrally with each other or formed continuously by individual members.

44. The image formation apparatus according to claim 42, wherein the transporting base plate which performs hopping of the fine particles by an electrostatic force has a plurality of electrodes which generate lines of electric force of a vertical component which serve as a hopping action above the electrodes.

45. The image formation apparatus according to claim 42, wherein the charge potential of the surface of the latent image carrier surface is |300| V or less.

46. The image formation apparatus according to claim 42, wherein driving waveforms where a driving frequency of each phase is in a range of 1 KHz to 15 KHz are applied to the electrodes of the transporting base plate which performs hopping of the fine particles by an electrostatic force.

47. An image formation apparatus which causes fine particles to adhere to a latent image carrier to develop a latent image on the latent image carrier, comprising:

an electrostatic transportation device which moves fine particles by an electrostatic force and which has a transporting base plate which transports the fine particles towards a developing section side by an electrostatic force, the transporting base plate having a plurality of electrodes which generates an electric field which performs transporting and hopping of the fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, and driving waveforms of n phases or more (n is an integer of 3 or more) are applied to respective electrodes; and an electrostatic transportation device which moves fine particles by an electrostatic force, and which has a transporting base plate which performs hopping of the transporting fine particles in the vicinity of the latent image carrier by an electrostatic force, the transporting base plate having a plurality of electrodes which generates an electric field which performs transporting and hopping of the fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, and driving waveforms of n phases or more (n is an integer of 3 or more) are applied to respective electrodes;

wherein a spacing between the latent image carrier and the surface of the transporting base plate which performs hopping of the fine particles by an electrostatic force is in a range of 2 to 10 times a hopping height of the fine particles.

48. The image formation apparatus according to claim 47, wherein a transporting base plate which transports the fine particles towards the developing section side by an electrostatic force and a transporting base plate which performs hopping of the fine particles in the vicinity of the latent image carrier by an electrostatic force are formed integrally with each other or formed continuously by individual members.

49. The image formation apparatus according to claim 47, wherein the transporting base plate which performs hopping of the fine particles by an electrostatic force has a plurality of electrodes which generate lines of electric force of a vertical component which serve as a hopping action above the electrodes.

50. The image formation apparatus according to claim 47, wherein the charge potential of the surface of the latent image carrier surface is |300| V or less.

51. The image formation apparatus according to claim 47, wherein driving waveforms where a driving frequency of each phase is in a range of 1 KHz to 15 KHz are applied to the electrodes of the transporting base plate which performs hopping of the fine particles by an electrostatic force.

52. An image formation apparatus which causes fine particles to adhere to a latent image carrier to develop a latent image on the latent image carrier, comprising:

an electrostatic transportation device which moves fine particles by an electrostatic force and which has a transporting base plate which transports the fine particles towards a developing section side by an electrostatic force, the transporting base plate having a plurality of electrodes which generates an electric field which performs transporting and hopping of the fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, and driving waveforms of n phases or more (n is an integer of 3 or more) are applied to respective electrodes; and an electrostatic transportation device which moves fine particles by an electrostatic force, and which has a transporting base plate which performs hopping of the transporting fine particles in the vicinity of the latent image carrier by an electrostatic force, the transporting base plate having a plurality of electrodes which generates an electric field which performs transporting and hopping of the fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, and driving waveforms of n phases or more (n is an integer of 3 or more) are applied to respective electrodes;

wherein a spacing between the latent image carrier and the surface of the transporting base plate which performs hopping of the fine particles by an electrostatic force is in a range of ½ to 2 times a hopping height of the fine particles.

53. The image formation apparatus according to claim 52, wherein a transporting base plate which transports the fine particles towards the developing section side by an electrostatic force and a transporting base plate which performs hopping of the fine particles in the vicinity of the latent image carrier by an electrostatic force are formed integrally with each other or formed continuously by individual members.

54. The image formation apparatus according to claim 52, wherein the transporting base plate which performs hopping of the fine particles by an electrostatic force has a plurality of electrodes which generate lines of electric force of a vertical component which serve as a hopping action above the electrodes.

55. The image formation apparatus according to claim 52, wherein the charge potential of the surface of the latent image carrier surface is |300| V or less.

56. The image formation apparatus according to claim 52, wherein driving waveforms where a driving frequency of each phase is in a range of 1 KHz to 15 KHz are applied to the electrodes of the transporting base plate which performs hopping of the fine particles by an electrostatic force.

57. An image formation apparatus which causes fine particles to adhere to a latent image carrier to develop a latent image on the latent image carrier, comprising:

an electrostatic transportation device which moves fine particles by an electrostatic force and which has a transporting base plate which transports the fine particles towards a developing section side by an electrostatic force, the transporting base plate having a plurality of electrodes which generates an electric field which performs transporting and hopping of the fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, and driving waveforms of n phases or more (n is an integer of 3 or more) are applied to respective electrodes; and an electrostatic transportation device which moves fine particles by an electrostatic force, and which has a transporting base plate which performs hopping of the transporting fine particles in the vicinity of the latent image carrier by an electrostatic force, the transporting base plate having a plurality of electrodes which generates an electric field which performs transporting and hopping of the fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, and driving waveforms of n phases or more (n is an integer of 3 or more) are applied to respective electrodes;

wherein driving waveforms where at least one phase is different in polarity from another phase are applied to the electrodes of the transporting base plate which performs hopping of the fine particles by an electrostatic force.

58. The image formation apparatus according to claim 57, wherein a transporting base plate which transports the fine particles towards the developing section side by an electrostatic force and a transporting base plate which performs hopping of the fine particles in the vicinity of the latent image carrier by an electrostatic force are formed integrally with each other or formed continuously by individual members.

59. The image formation apparatus according to claim 57, wherein the transporting base plate which performs hopping of the fine particles by an electrostatic force has a plurality of electrodes which generate lines of electric force of a vertical component which serve as a hopping action above the electrodes.

60. The image formation apparatus according to claim 57, wherein the charge potential of the surface of the latent image carrier surface is |300| V or less.

61. The image formation apparatus according to claim 57, wherein driving waveforms where a driving frequency of each phase is in a range of 1 KHz to 15 KHz are applied to the electrodes of the transporting base plate which performs hopping of the fine particles by an electrostatic force.

62. An image formation apparatus which causes fine particles to adhere to a latent image carrier to develop a latent image on the latent image carrier, comprising:

an electrostatic transportation device which moves fine particles by an electrostatic force and which has a transporting base plate which transports the fine particles towards a developing section side by an electrostatic force, the transporting base plate having a plurality of electrodes which generates an electric field which performs transporting and hopping of the fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, and driving waveforms of n phases or more (n is an integer of 3 or more) are applied to respective electrodes; and an electrostatic transportation device which moves fine particles by an electrostatic force, and which has a transporting base plate which performs hopping of the transporting fine particles in the vicinity of the latent image carrier by an electrostatic force, the transporting base plate having a plurality of electrodes which generates an electric field which performs transporting and hopping of the fine particles by an electrostatic force, wherein a width of each of the electrodes in a traveling direction of the fine particles is set to be in a range of 1 time to 20 times an average particle diameter of the fine particles, a pitch between the electrodes in the traveling direction of the fine particles is set to be in a range of 1 time to 20 times the average particle diameter of the fine particles, and driving waveforms of n phases or more (n is an integer of 3 or more) are applied to respective electrodes;

wherein a driving waveform which is applied to the electrodes of the transporting base plate which transport the fine particles by an electrostatic force and a driving waveform which is applied to the electrodes of the transporting base plate which perform hopping of the fine particles are different in frequency and/or voltage application duty cycle.

63. The image formation apparatus according to claim 62, wherein a transporting base plate which transports the fine particles towards the developing section side by an electrostatic force and a transporting base plate which performs hopping of the fine particles in the vicinity of the latent image carrier by an electrostatic force are formed integrally with each other or formed continuously by individual members.

64. The image formation apparatus according to claim 62, wherein the transporting base plate which performs hopping of the fine particles by an electrostatic force has a plurality of electrodes which generate lines of electric force of a vertical component which serve as a hopping action above the electrodes.

65. The image formation apparatus according to claim 62, wherein the charge potential of the surface of the latent image carrier surface is |300| V or less.

66. The image formation apparatus according to claim 62, wherein driving waveforms where a driving frequency of each phase is in a range of 1 KHz to 15 KHz are applied to the electrodes of the transporting base plate which performs hopping of the fine particles by an electrostatic force.

* * * * *